US010843029B2

(12) United States Patent
Boatwright

(10) Patent No.: US 10,843,029 B2
(45) **Date of Patent: *Nov. 24, 2020**

(54) CABLE EXERCISE DEVICE AND METHOD

(71) Applicant: Donald Jeffrey Boatwright, Charlotte, NC (US)

(72) Inventor: Donald Jeffrey Boatwright, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/209,331

(22) Filed: Dec. 4, 2018

(65) Prior Publication Data

US 2019/0105526 A1 Apr. 11, 2019

Related U.S. Application Data

(63) Continuation of application No. 15/476,387, filed on Mar. 31, 2017, now Pat. No. 10,143,880, which is a (Continued)

(51) Int. Cl.
*A63B 21/00* (2006.01)
*A63B 21/062* (2006.01)

(Continued)

(52) U.S. Cl.
CPC ..... *A63B 21/153* (2013.01); *A63B 21/0051* (2013.01); *A63B 21/00069* (2013.01); *A63B 21/015* (2013.01); *A63B 21/06* (2013.01); *A63B 21/062* (2013.01); *A63B 21/0628* (2015.10); *A63B 21/075* (2013.01); *A63B 21/078* (2013.01); *A63B 21/157* (2013.01); *A63B 21/4033* (2015.10); *A63B 21/4043* (2015.10);

(Continued)

(58) Field of Classification Search
CPC ... A63B 21/153; A63B 21/075; A63B 21/062; A63B 21/00058; A63B 21/00065; A63B 21/06062; A63B 21/0626; A63B 21/0628; A63B 21/063; A63B 21/0632; A63B 21/15; A63B 21/151; A63B 21/154; A63B 23/12; A63B 23/03508; A63B 23/0355; A63B 23/0405; A63B 23/0411
See application file for complete search history.

(56) References Cited

U.S. PATENT DOCUMENTS 141,967 A 8/1873 Van Houten
3,640,530 A 2/1972 Henson (Continued)

OTHER PUBLICATIONS

U.S. Appl. No. 14/639,402, filed Mar. 5, 2015.

(Continued)

*Primary Examiner* — Megan Anderson
(74) *Attorney, Agent, or Firm* — Schwartz Law Firm, P.C.

(57) ABSTRACT

A cable exercise device includes a vertically movable weight stack, a rotatable spool assembly, first and second cables, and a movable exercise implement. The rotatable spool assembly is located proximate the weight stack, and comprises spaced apart large and small cable spools affixed to a common rotatable spool shaft. The first cable has a terminal end attached to the weight stack and a winding end attached to the small cable spool. The second cable has a winding end attached to the large cable spool, and extends from the large cable spool to a terminal end. The movable exercise implement is secured to the cable exercise device by the terminal end of the second cable, and is adapted for being employed by a user performing an exercise.

18 Claims, 22 Drawing Sheets

Related U.S. Application Data continuation-in-part of application No. 15/353,220, filed on Nov. 16, 2016, now Pat. No. 10,029,138, which is a continuation of application No. 14/639,402, filed on Mar. 5, 2015, now Pat. No. 9,700,753, which is a continuation-in-part of application No. 14/502,068, filed on Sep. 30, 2014, now Pat. No. 9,498,666, which is a continuation of application No. 13/315,847, filed on Dec. 9, 2011, now Pat. No. 8,845,499.

(51) Int. Cl.

| | |
|---|---|
| ***A63B 21/075*** | (2006.01) |
| ***A63B 23/12*** | (2006.01) |
| ***A63B 21/06*** | (2006.01) |
| ***A63B 21/015*** | (2006.01) |
| ***A63B 23/035*** | (2006.01) |
| ***A63B 21/078*** | (2006.01) |
| ***A63B 21/005*** | (2006.01) |
| *A63B 23/04* | (2006.01) |
| *A63B 71/06* | (2006.01) |
| *A63B 71/02* | (2006.01) |
| *A63B 24/00* | (2006.01) |

(52) U.S. Cl.

CPC ..... *A63B 23/03525* (2013.01); *A63B 23/12* (2013.01); *A63B 21/00058* (2013.01); *A63B 21/0058* (2013.01); *A63B 21/00065* (2013.01); *A63B 21/0626* (2015.10); *A63B 21/15* (2013.01); *A63B 21/151* (2013.01); *A63B 21/154* (2013.01); *A63B 21/4035* (2015.10); *A63B 23/0405* (2013.01); *A63B 2023/0411* (2013.01); *A63B 2024/0093* (2013.01); *A63B 2071/027* (2013.01); *A63B 2071/065* (2013.01); *A63B 2220/52* (2013.01); *A63B 2225/09* (2013.01); *A63B 2225/50* (2013.01)

(56) References Cited

U.S. PATENT DOCUMENTS

| | | | |
|---|---|---|---|
| 3,785,644 | A | 1/1974 | Bradley et al. |
| 3,929,331 | A | 12/1975 | Beeding |
| 3,995,853 | A | 12/1976 | Deluty |
| 4,082,267 | A | 4/1978 | Flavell |
| 4,090,694 | A | 5/1978 | Vincent |
| 4,138,106 | A | 2/1979 | Bradley |
| 4,235,439 | A | 11/1980 | De Donno |
| 4,479,647 | A | 10/1984 | Smith |
| 5,031,900 | A | 7/1991 | Leask |
| 5,090,694 | A | 2/1992 | Pauls |
| 5,139,469 | A | 8/1992 | Hennessey et al. |
| 5,154,684 | A | 10/1992 | Delf |
| 5,400,875 | A | 3/1995 | Anthony et al. |
| 5,429,572 | A | 7/1995 | Brown |
| 5,433,299 | A | 7/1995 | Sundstorm et al. |
| 5,484,368 | A | 1/1996 | Chang |
| 5,586,624 | A | 12/1996 | Ko et al. |
| 5,992,618 | A | 11/1999 | Joh |
| 6,030,321 | A | 2/2000 | Fuentes |
| 6,071,215 | A | 6/2000 | Raffo |
| 6,315,701 | B1 | 11/2001 | Shifferaw |
| 6,450,922 | B1 | 9/2002 | Henderson et al. |
| 6,569,065 | B1 | 5/2003 | Menold et al. |
| 6,612,170 | B2 | 9/2003 | Brown |
| 6,659,922 | B1 | 12/2003 | Yu |
| 6,726,607 | B1 | 4/2004 | Ihli |
| 6,749,050 | B2 | 6/2004 | Ouchi |
| 6,770,014 | B2 | 8/2004 | Amore |
| 7,087,001 | B1 | 8/2006 | Ihli |
| 7,094,184 | B1 | 8/2006 | Chen et al. |
| 7,506,697 | B2 | 3/2009 | Pflieger |
| 7,625,321 | B2 | 12/2009 | Simonson |
| 7,909,745 | B2 | 3/2011 | Mills et al. |
| 8,585,561 | B2 | 11/2013 | Watt et al. |
| 8,845,499 | B1 | 9/2014 | Boatwright |
| 9,498,666 | B1 | 11/2016 | Boatwright |
| 10,143,880 | B1 | 12/2018 | Boatwright |
| 2003/0087735 | A1 | 5/2003 | Chen |
| 2004/0102292 | A1 | 5/2004 | Pyles et al. |
| 2004/0204293 | A1 | 10/2004 | Andreasen |
| 2007/0284209 | A1 | 12/2007 | Chen |
| 2008/0096725 | A1 | 4/2008 | Keiser |
| 2010/0144496 | A1 | 6/2010 | Schmidt |
| 2010/0216600 | A1 | 8/2010 | Noffsinger |
| 2014/0274600 | A1 | 9/2014 | Dalebout |
| 2015/0011368 | A1 | 1/2015 | Manor |

OTHER PUBLICATIONS

U.S. Appl. No. 15/353,220, filed Nov. 16, 2016.

Kettler USA; "Kettler Coach Rowers w/ over 16 Different Exercises"; http://www.kettlerusa.com/blog/?p+293; pp. 1-3; Published prior to Sep. 10, 2012.

CABLE EXERCISE DEVICE AND METHOD

TECHNICAL FIELD AND BACKGROUND OF THE INVENTION

This invention relates broadly and generally to the fitness industry, and in one embodiment, more particularly to a cable exercise device incorporating multiple individual cables carried on respective individual cable spools. In exemplary embodiments discussed herein, the present exercise device is generally light weight, compact in size, and portable, can be conveniently stored under a bed or in a closet, and can be readily transported anywhere by anyone. Exemplary embodiments of the present invention may combine various structural features and elements described in Applicant's prior issued U.S. Pat. No. 8,845,499. The complete disclosure of this prior patent is incorporated herein by reference.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a personal force-resistance cable exercise device. The exercise device includes a force resistance assembly, elongated flexible cable, and a movable exercise implement. The force resistance assembly comprises a mounting frame, a rotatable assembly shaft carried by the mounting frame, a disk rotor fixedly attached to the assembly shaft, an adjustable friction controller adapted for frictionally engaging the disk rotor, and a one-way cable spool. The one-way cable spool is locked to the assembly shaft upon rotation of the cable spool in a working force-resistance direction, and is freely movable relative to the assembly shaft upon rotation of cable spool in an opposite cable-wind-up direction. The flexible cable is attached to the force resistance assembly, and adapted for winding on and unwinding from the cable spool. The exercise implement is attached (either directly or indirectly) to the flexible cable, and is adapted for being employed by a user performing an exercise.

The term "one-way cable spool" refers broadly herein to any rotatable unit which is allowed to substantially free-wheel in one direction on a shaft, but when a torque is applied in the opposite direction, the unit locks, binds, or wedges onto the shaft because of changes in bearing alignment and friction. In the present exemplary embodiment, the cable spool operates in "one-way" by locking onto the assembly shaft when rotated in the working or force-resistance direction, but slips over the assembly shaft when counter-rotated in the cable-wind-up direction.

According to another exemplary embodiment, a cable rewind spring is operatively attached to the one-way cable spool, and is adapted for normally urging rotation of the cable spool in the cable-wind-up direction. Alternatively, the cable spool may be rotated in the cable-wind-up direction via DC motor, or other electro-mechanical or mechanical means.

According to another exemplary embodiment, the one-way cable spool incorporates a one-way needle bearing adapted for operatively engaging the assembly shaft upon rotation of the cable spool in the working force-resistance direction. The needle bearing may be integrally formed with the cable spool, or separately formed and permanently attached (e.g., by press-fit, welding or other means). In alternative arrangements, a sprag clutch or other means may be employed to effect one-way operation of the cable spool.

According to another exemplary embodiment, the one-way cable spool comprises a plurality of circumferential grooves adapted for controlling overlap of the cable when winding on the spool.

According to another exemplary embodiment, first and second end bearings are attached to the mounting frame and located at respective opposite ends of the assembly shaft.

According to another exemplary embodiment, the friction controller incorporates a hand-turnable adjustment knob.

According to another exemplary embodiment, the friction controller further comprises first and second cooperating friction pads adapted for operatively engaging respective opposite surfaces of the disk rotor. The friction pads may be hydraulically actuated (as with a conventional hydraulic brake assembly) or mechanically non-hydraulically actuated via attached wires.

According to another exemplary embodiment, a pivoted foot stop is designed for operatively engaging the cable spool to limit rotation of the cable spool in the cable-wind-up direction.

According to another exemplary embodiment, a standing platform is located adjacent the force resistance assembly.

According to another exemplary embodiment, the exercise implement comprises an elongated hollow (e.g., metal) bar having a cable-entry end and an opposing cable-exit end, and bar pulleys located at respective cable-entry and cable-exit ends. The flexible cable extends through the exercise bar and outwardly from its cable-exit end towards the standing platform.

According to another exemplary embodiment, means are provided for releasably attaching the free end of the flexible cable to the standing platform.

According to another exemplary embodiment, the means for releasably attaching the flexible cable comprises a cam cleat fixed to the standing platform.

According to another exemplary embodiment, an electronic scale is adapted for measuring a force exerted by the user when performing the exercise.

According to another exemplary embodiment, a display monitor is connected to the scale for displaying the measured force exerted by the user.

In another exemplary embodiment, the present disclosure comprises a cable exercise device including a force resistance assembly, an elongated flexible cable, and a movable exercise implement. In this embodiment, the force resistance assembly comprises a rotatable assembly shaft and a one-way cable spool carried by the assembly shaft. The force resistance assembly further comprises means for locking the one-way cable spool to the assembly shaft upon rotation of the cable spool in a working force-resistance direction, and for enabling free movement of cable spool relative to the assembly shaft upon rotation of cable spool in an opposite cable-wind-up direction. The flexible cable is attached to the force resistance assembly, and is adapted for winding on and unwinding from the cable spool. The movable exercise implement is attached (either directly or indirectly) to the flexible cable, and is adapted for being employed by a user performing an exercise. The exercise implement may comprise any movable structure designed for being pushed, pulled, pressed, curled, raised, lifted, or otherwise moved by a user against the force of the resistance assembly in one or more exercise repetitions utilizing the exemplary exercise device.

In yet another exemplary embodiment, the present disclosure comprises a method for exercising. The method includes exerting a force (directly or indirectly) against an exercise implement attached (directly or indirectly) to an elongated flexible cable. The flexible cable is attached to a force resistance assembly comprising a mounting frame, a rotatable assembly shaft carried by the mounting frame, a disk rotor fixedly attached to the assembly shaft, an adjustable friction controller adapted for frictionally engaging the disk rotor, and a one-way cable spool. The one-way cable spool is locked to the assembly shaft upon rotation of the cable spool in a working force-resistance direction, and is freely movable relative to the assembly shaft upon rotation of cable spool in an opposite cable-wind-up direction.

In yet another exemplary embodiment, the present disclosure comprises a cable exercise device incorporating a force resistance assembly, elongated flexible cable, and movable exercise implement. The force resistance assembly includes a mounting frame, a rotatable axle supported by the mounting frame, a one-way cable spool carried by the axle, and a magnetic braking device operatively connected to the cable spool. The one-way cable spool locks to the axle upon rotation of the cable spool in a working force-resistance direction, and is freely movable relative to the axle upon rotation of cable spool in an opposite cable-wind-up direction. The flexible cable is attached to the force resistance assembly, and is adapted for winding on and unwinding from the cable spool. The exercise implement is secured to the flexible cable, and is adapted for being employed by a user performing an exercise.

The term "exercise implement" refers broadly herein to any movable structure designed for being pushed, pulled, pressed, curled, raised, lifted, or otherwise moved by a user against the force of the resistance assembly in one or more exercise repetitions utilizing the exemplary exercise device.

According to one exemplary embodiment, the magnetic braking device comprises an eddy current braking system incorporating a flywheel and at least one magnet (e.g., electromagnet). Examples of eddy current braking systems are provided in prior U.S. Pat. Nos. 7,094,184, 6,450,922, and 5,031,900. The complete disclosure of these prior patents is incorporated herein by reference. In alternative embodiments, the magnetic braking device comprises a hysteresis braking system, or a combination of eddy current and hysteresis braking systems. Alternatively, or in addition, the present braking system may incorporate one or more permanent and/or electromagnets in a similar manner described in prior U.S. Pat. No. 8,585,561. According to the resistance system of the '561 Patent, the magnets are moved (shifted) relative to the flywheel to increase and reduce the drag or braking force on the flywheel. The complete disclosure of the '561 Patent is also incorporated by reference herein.

According to another exemplary embodiment, the force resistance assembly further comprises a pulley fixed to the axle and a (friction) drive belt. The drive belt operatively interconnects the pulley and the flywheel of the eddy current braking system.

According to another exemplary embodiment, an electronic operator console communicates (via cable or wirelessly) with the eddy current braking system, and is adapted for supplying an electric current to the electromagnet.

According to another exemplary embodiment, the operator console comprises an operator button for selecting one of a plurality of different current levels (e.g., 40 or more) to supply to the electromagnet.

According to another exemplary embodiment, a cable rewind spring is operatively attached to the one-way cable spool, and is adapted for normally urging rotation of the cable spool in the cable-wind-up direction. Alternatively, the cable spool may be counter rotated in the cable-wind-up direction via DC motor, or other electro-mechanical or mechanical means.

According to another exemplary embodiment, the one-way cable spool comprises a one-way needle bearing adapted for operatively engaging the axle upon rotation of the cable spool in the working force-resistance direction. The needle bearing may be integrally formed with the cable spool, or separately formed and permanently attached (e.g., by press-fit, welding or other means). In alternative arrangements, a sprag clutch or other means may be employed to effect one-way operation of the cable spool.

According to another exemplary embodiment, the exercise implement comprises an elongated hollow metal bar having a cable-entry end and an opposing cable-exit end, and first and second cable bearings located at respective cable-entry and cable-exit ends. The term "cable bearing" refers broadly herein to any device (such as a rotatable pulley or plain bearing) that supports, guides, and reduces the friction of motion between the cable and exercise implement.

According to another exemplary embodiment, a standing platform is located adjacent to the force resistance assembly.

According to another exemplary embodiment, means are provided for releasably attaching the free end of the flexible cable to the standing platform.

According to another exemplary embodiment, the means for releasably attaching the flexible cable comprises a metal carabiner.

According to another exemplary embodiment, an electronic scale is formed with or located adjacent the standing platform for measuring a force exerted by the user when performing the exercise.

In another exemplary embodiment, the present disclosure comprises a cable exercise device incorporating a force resistance assembly, an elongated flexible cable, and a moveable exercise implement. The force resistance assembly comprises a mounting frame, a rotatable axle operatively supported by the mounting frame, a cable spool carried by the axle, and a magnetic braking device operatively connected to the cable spool. The magnetic braking device comprises an eddy current braking system incorporating a flywheel and electromagnet. The flexible cable is attached to the force resistance assembly, and is adapted for winding on and unwinding from the cable spool. The movable exercise implement is secured to the flexible cable, and is adapted for being employed by a user performing an exercise.

In yet another exemplary embodiment, the present disclosure comprises a method for exercising. The method includes exerting a force (directly or indirectly) against an exercise implement attached (directly or indirectly) to an elongated flexible cable. The flexible cable is attached to a force resistance assembly comprising a mounting frame, a rotatable axle supported by the mounting frame, a one-way cable spool carried on the axle, and a magnetic braking device. The one-way cable spool is locked to the axle upon rotation of the cable spool in a working force-resistance direction, and is freely movable relative to the axle upon rotation of cable spool in an opposite cable-wind-up direction.

In yet another exemplary embodiment, the present disclosure comprises a cable exercise device including a vertically movable weight stack, a rotatable spool assembly, first and second cables, and a movable exercise implement. The rotatable spool assembly is located proximate the weight stack, and comprises spaced apart large and small cable spools affixed to a common rotatable spool shaft. The first cable has a terminal end attached to the weight stack and a winding end attached to the small cable spool. The winding end of the first cable is adapted to wind onto and unwind from the small cable spool on a first side of the spool shaft upon rotation of the spool assembly. The second cable has a winding end attached to the large cable spool, and extends from the large cable spool to a terminal end. The winding end of the second cable is adapted to wind onto and unwind from the large cable spool on a second side of the spool shaft upon rotation of the spool assembly. The movable exercise implement is secured to the cable exercise device by the terminal end of the second cable, and is adapted for being employed by a user performing an exercise. Positive displacement of the exercise implement when lifted causes the second cable to unwind from the large cable spool, thereby rotating the spool assembly while simultaneously causing the first cable to wind upon the small cable spool such that the first cable lifts the weight stack vertically from an initial at-rest position to an elevated position.

According to another exemplary embodiment, the weight stack comprises a plurality of individual weight stack plates. Each plate has top and bottom major (planar) surfaces, and vertical sides extending between the top and bottom surfaces.

According to another exemplary embodiment, each weight stack plate defines a central shaft opening formed between its top and bottom major surfaces, and a central pin opening formed through at least one side of the plate and communicating with the shaft opening.

According to another exemplary embodiment, an elongated selector shaft is attached to the terminal end of the first cable, and is adapted for extending through the shaft openings formed with the weight stack plates.

According to another exemplary embodiment, a weight stack pin is adapted for inserting through the pin opening of a selected weight stack plate and into an aligned one of a plurality of longitudinally spaced pin holes formed with the selector shaft.

According to another exemplary embodiment, first and second vertical guide rods are adapted for guiding vertical movement of the weight stack between its initial at-rest position and the elevated position.

According to another exemplary embodiment, a floor anchor is attached to the terminal end of the second cable.

According to another exemplary embodiment, the exercise implement comprises an elongated hollow bar having a cable-entry end and an opposing cable-exit end, and first and second bar guides located at respective cable-entry and cable-exit ends. The second cable extends through the bar and outwardly from its cable-exit end towards the floor anchor.

According to another exemplary embodiment, the large cable spool of the spool assembly comprises a plurality of circumferential grooves adapted for controlling overlap of the second cable when winding on the spool.

According to another exemplary embodiment, the small cable spool of the spool assembly comprises a plurality of circumferential grooves adapted for controlling overlap of the first cable when winding on said spool.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
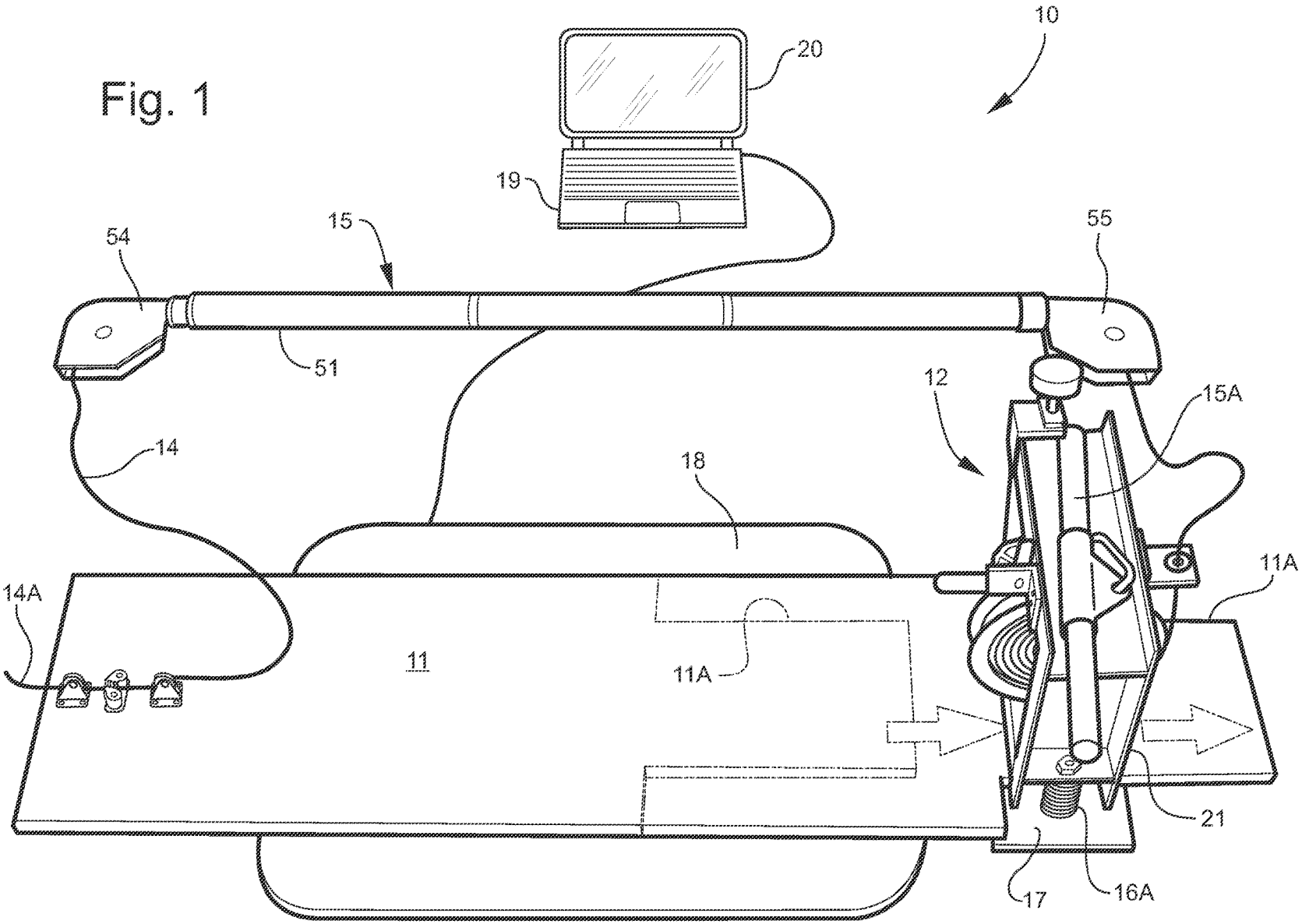
FIG. 1 is a perspective view of a personal force-resistance exercise device according to one exemplary embodiment of the present disclosure.

Referring now specifically to the drawings, a personal force-resistance cable exercise device according to one exemplary embodiment of the present disclosure is illustrated in FIG. 1, and shown generally at broad reference numeral 10. The exemplary exercise device 10 comprises a rigid standing platform 11, a compact force resistance assembly 12 adjacent the platform 11, a flexible steel cable 14 attached to the force resistance assembly 12, and an elongated double-pulley exercise bar 15 attached to the cable 14. The force resistance assembly 12 is carried by spaced-apart heavy gauge coil springs 16A, 16B (FIG. 5), and is bolted to a relatively small flat planar base 17. The standing platform 11 is unattached to the force resistance assembly 12, and may have a notched end 11A designed to fit between the coil springs 16A, 16B and over the assembly base 17. In one embodiment, the exemplary platform 11 sits atop an electronic scale 18 communicating (via wired or wireless connection) with computer 19 for measuring real-time force exerted by the user when performing an exercise. The measured force may be displayed to the user on monitor 20.

Figure 2:
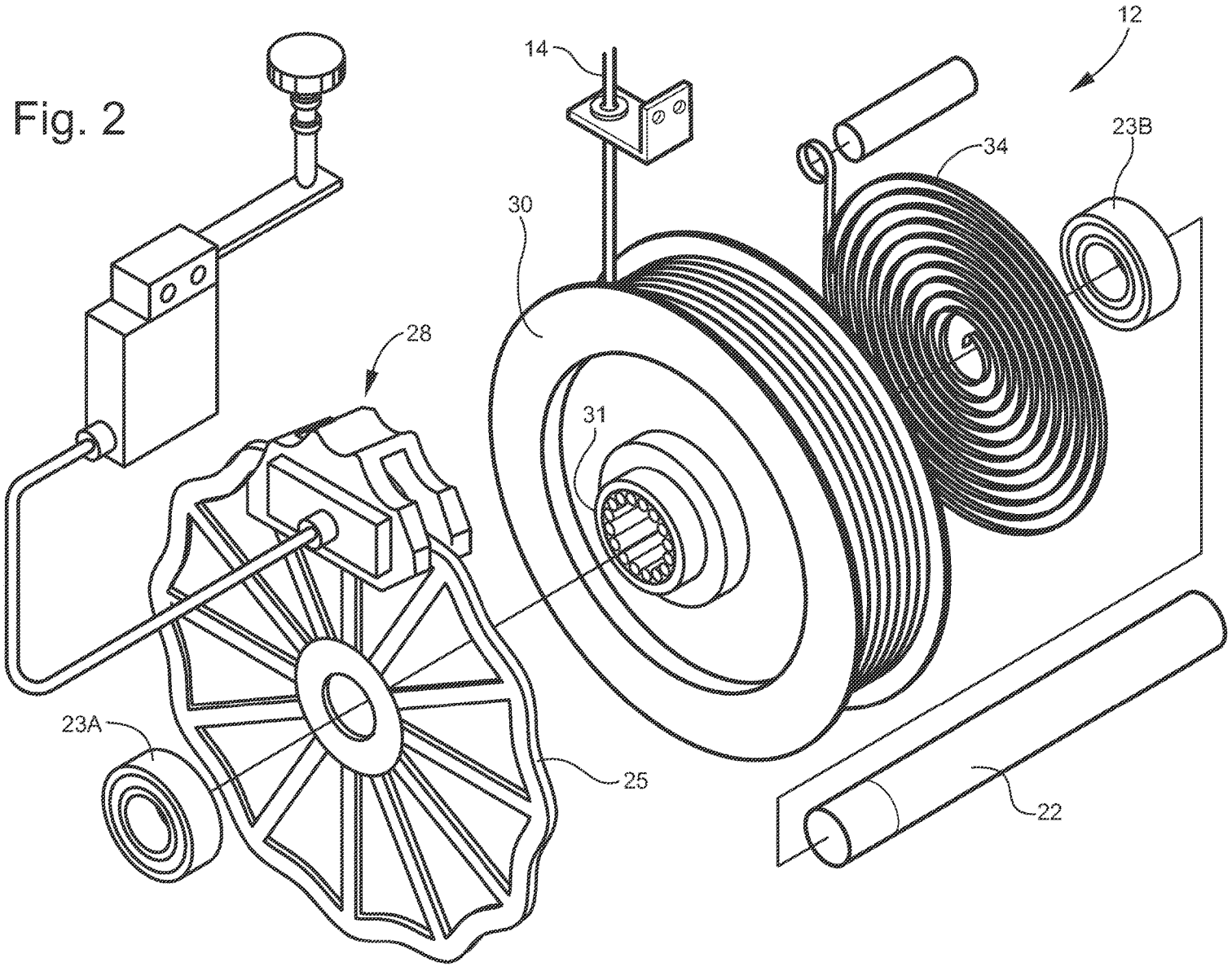
FIG. 2 is an exploded view illustrating various parts of the force resistance assembly.
Figure 3:
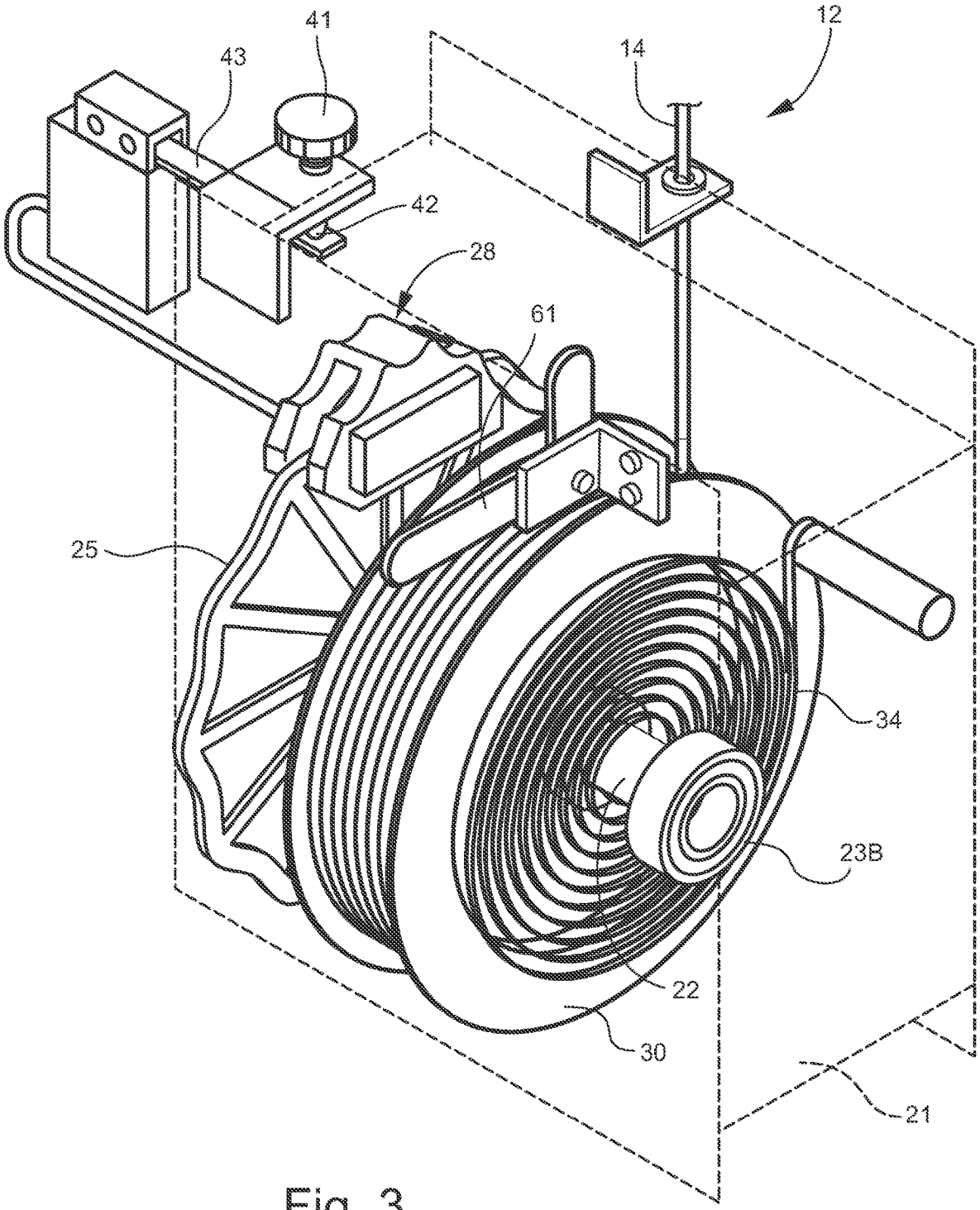
FIG. 3 is an assembled perspective view of the exemplary force resistance assembly.
Figure 4:
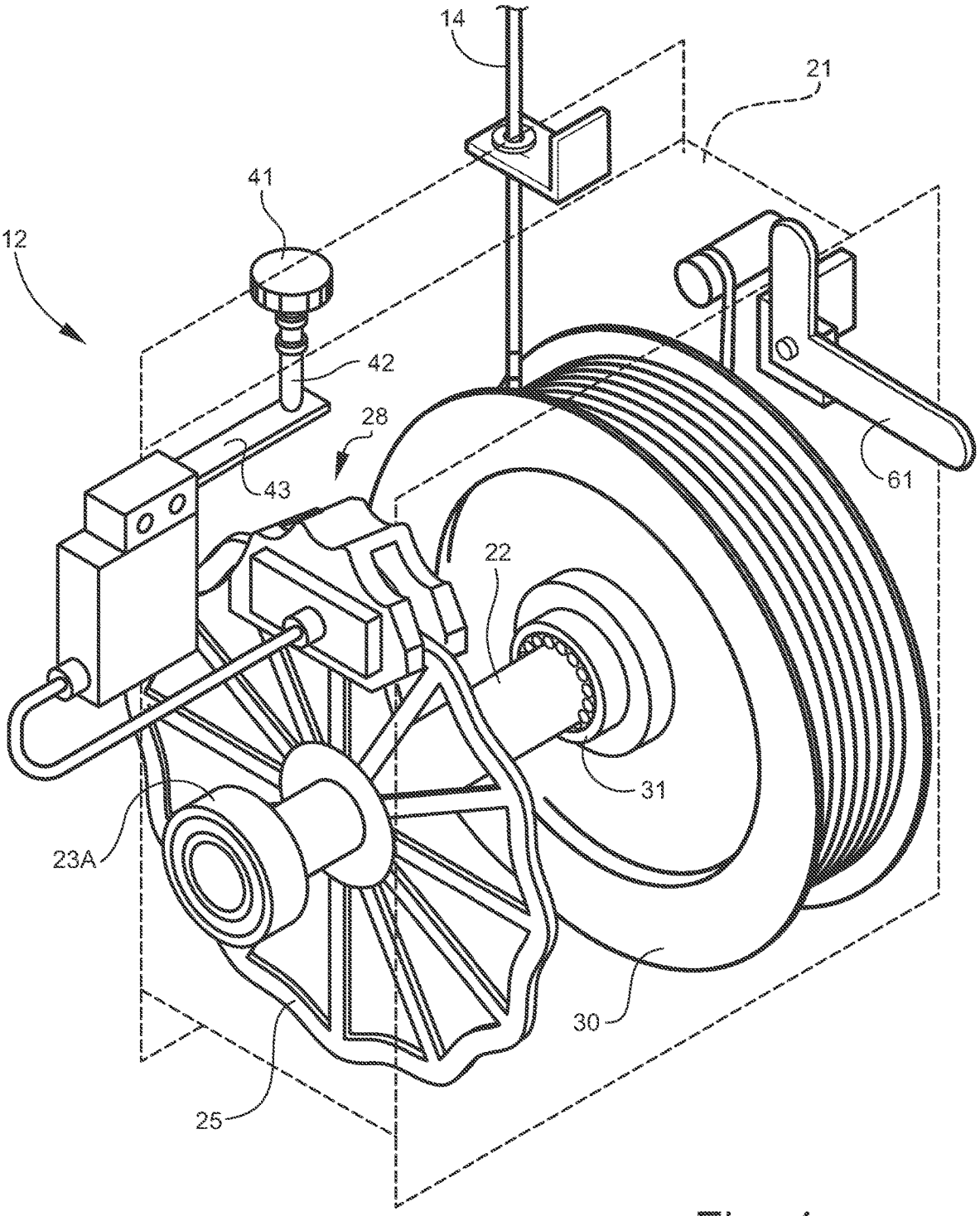
FIG. 4 is a further assembled perspective view of the exemplary force resistance assembly.

As best shown in FIGS. 2, 3, and 4, the exemplary force resistance assembly 12 comprises a steel mounting frame 21 (FIG. 1), a rotatable assembly shaft 22 supported by end bearings 23A, 23B within the frame 21, a disk rotor 25 fixedly attached (e.g., by welding) to the assembly shaft 22, an adjustable hydraulic friction controller 28 designed to frictionally engage the disk rotor 25, and a one-way cable spool 30. The exemplary assembly shaft 22 may be fabricated of a hardened steel or other metal, or may comprise a less expensive metal with a press-fit hardened outer steel sleeve. The one-way cable spool 30 comprises an integrally (or separately) formed one-way needle bearing 31 which locks to the hardened assembly shaft 22 upon rotation of the cable spool 30 in a working force-resistance direction, and which releases from the assembly shaft 22 upon counter-rotation of the cable spool 30 in an opposite cable-wind-up direction. The flexible cable 14 is attached to the force resistance assembly 12 (e.g., at cable spool 30), and is adapted for winding on and unwinding from the cable spool 30 during use of the exercise device 10, as discussed further below. The exemplary cable spool 30 defines circumferential surface grooves 33 (FIG. 5) which serve to limit (or substantially prevent) overlap of the cable 14 when winding on the spool 30. A spiral torsion spring 34 or other biasing means is attached at one end to the mounting frame 21 and at its other end to the cable spool 30, and functions to normally urge counter-rotation of the cable spool 30 in the cable-wind-up direction.

Figure 5:
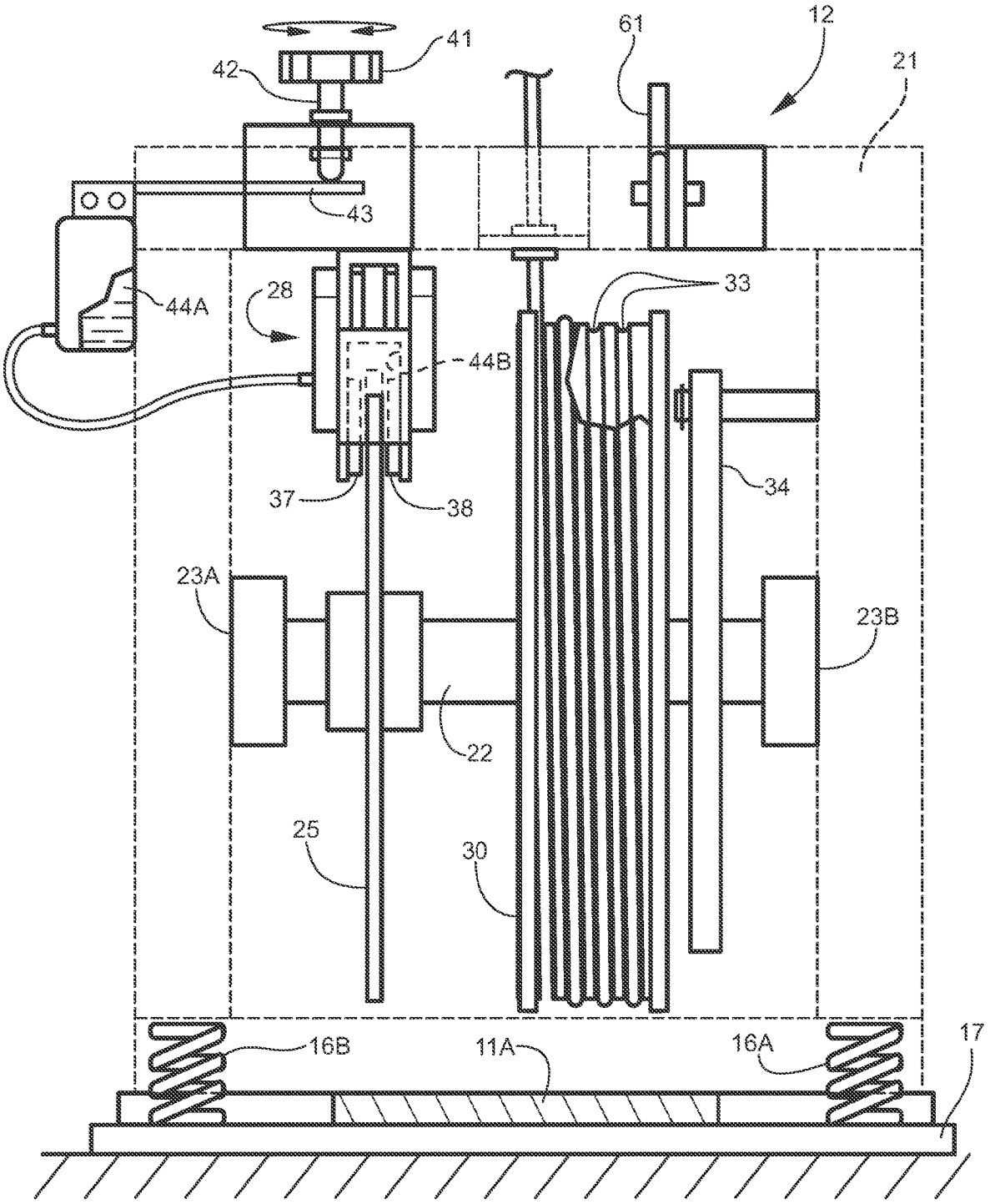
FIG. 5 is a side view of the assembled force resistance assembly.
Figure 5A:
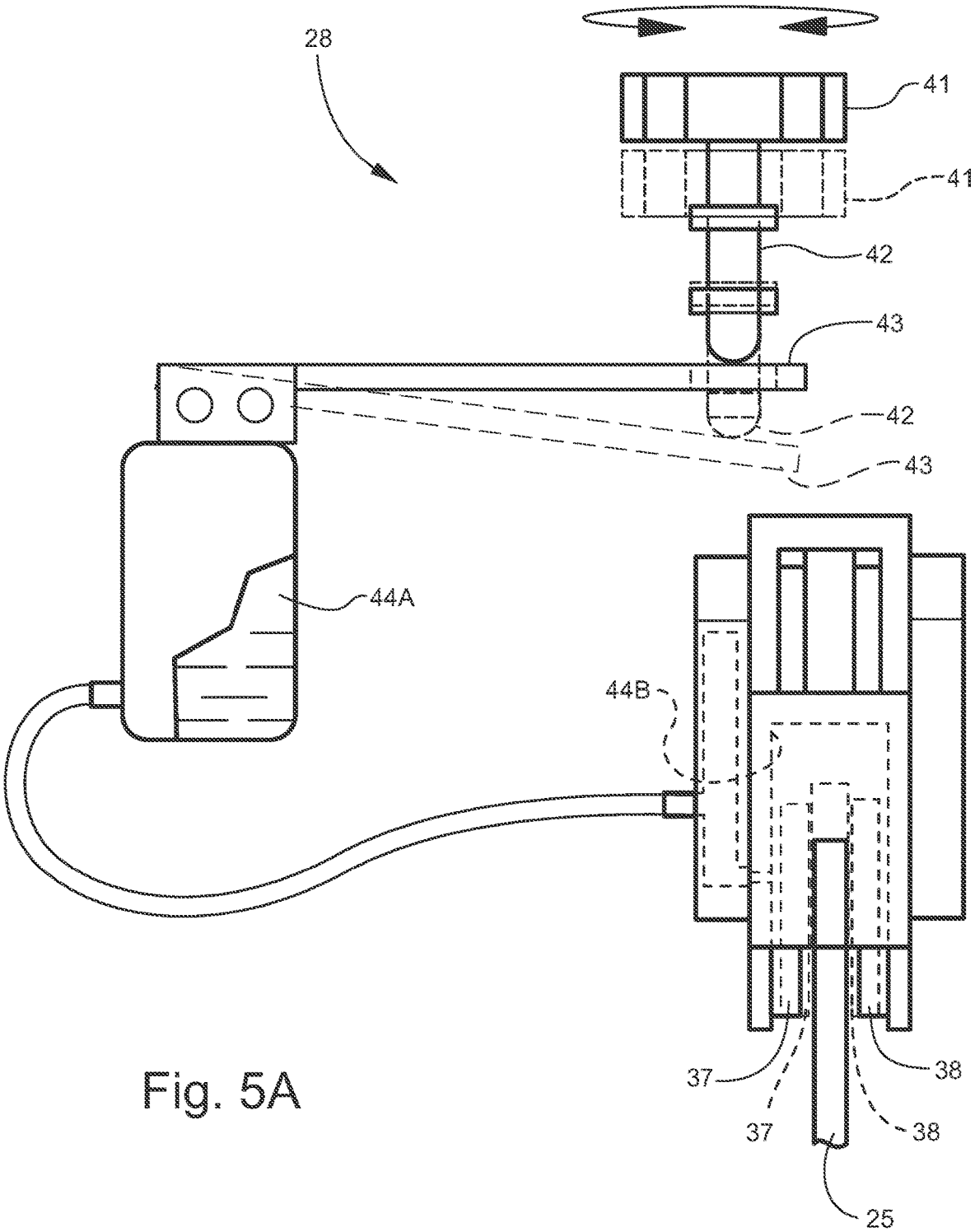
FIG. 5A is a view illustrating various parts of the adjustable hydraulic friction controller.
Figure 6:
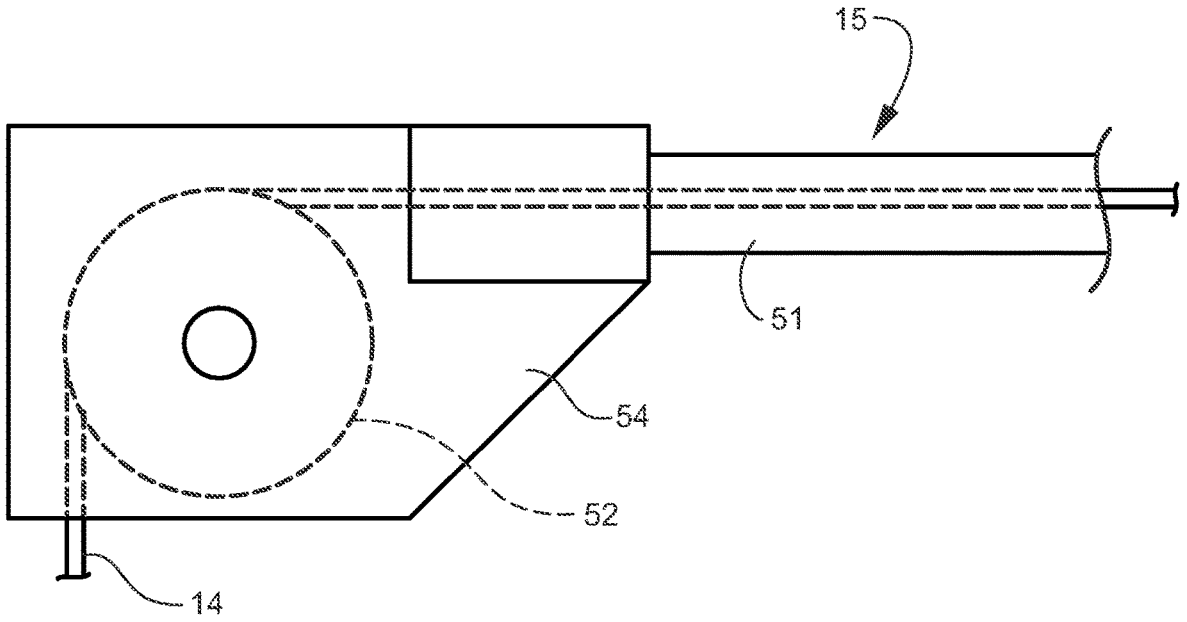
FIG. 6 is a fragmentary view of the elongated exercise bar showing the bracket and pulley assembly at one end.

Referring to FIGS. 5 and 5A, the adjustable friction controller 28 comprises cooperating hydraulic friction pads 37, 38 fabricated of a high-durometer rubber or other such material, and designed to frictionally engage opposite sides of the metal disk rotor 25 upon rotation of the cable spool 30 and assembly shaft 22. A hand-turnable adjustment knob 41, threaded knob shaft 42 and valve lever 43 cooperate to control the flow of hydraulic fluid from reservoir 44A into chamber 44B causing friction pads 37, 38 to increase or decrease frictional contact with the disk rotor 25. The adjustment knob 41 temporarily sets the desired force resistance, and enables substantially infinite precision adjustment within a wide range—i.e., from substantially zero resistance (free rotation) to substantial immovability. The adjustment knob may also comprise resistance-setting indicia not shown.

Figure 7:
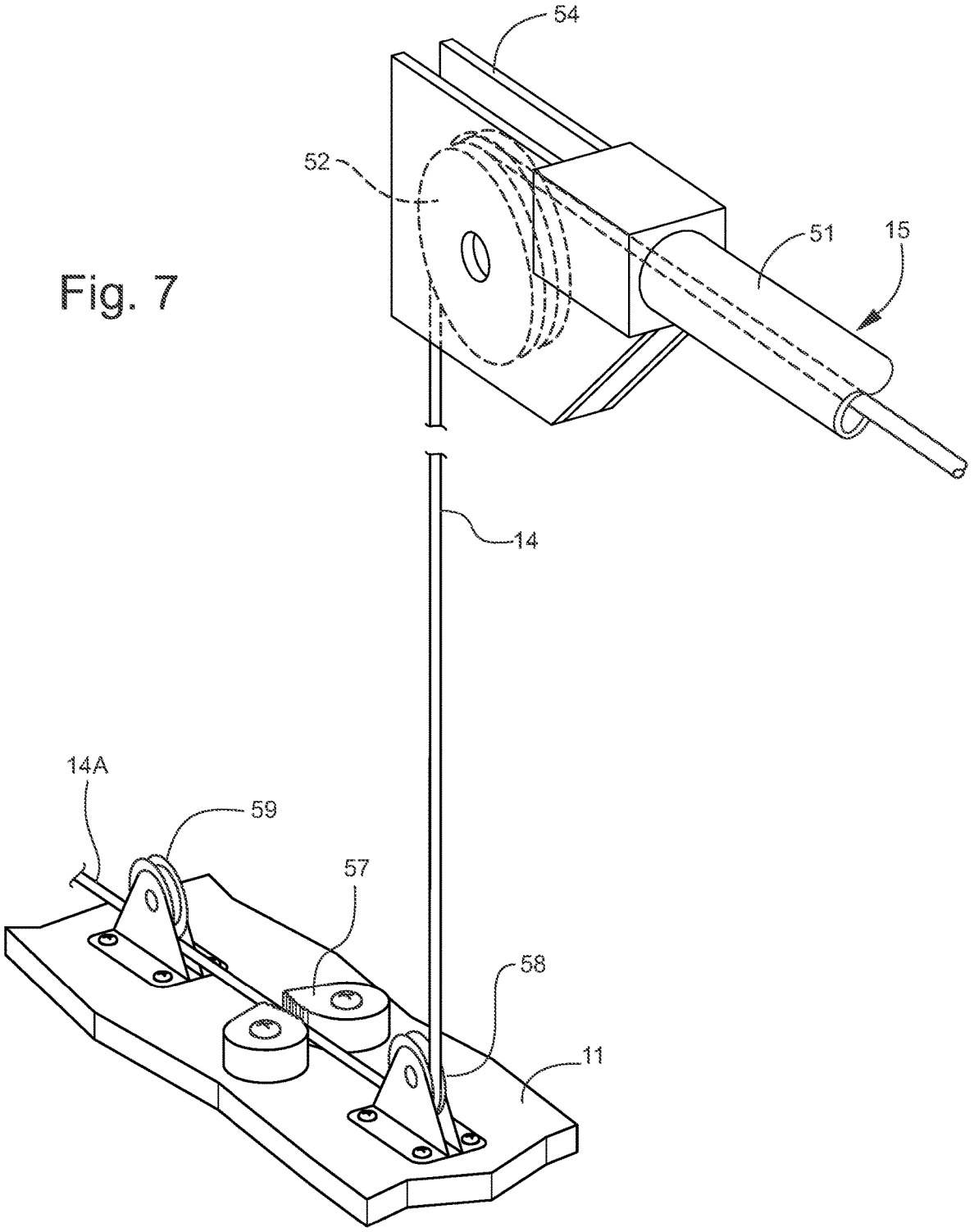
FIG. 7 is a fragmentary perspective view if the exercise bar and standing platform showing the cam cleat designed for securing the free end of the flexible cable.

The exemplary exercise bar 15 may be secured to the flexible cable 14, as illustrated in FIGS. 1, 6, 7, and 8. In this embodiment, the exercise bar 15 comprises an elongated rigid hollow member 51 with respective bar pulleys 52, 53 located at opposite open ends. The bar pulleys 52, 53 are attached via brackets 54, 55. A free end 14A of the flexible cable 14 is passed into the exercise bar 15 over bar pulley 52, and into and through hollow member 51, and outwardly over bar pulley 53 towards the standing platform 11. The cable 14 is temporarily fixed to the standing platform 11, as best shown in FIG. 7, by inserting the free end 14A through cam cleat 57 and spaced pulleys 58, 59 mounted on the platform 11. Pulling additional cable 14 through the cam cleat 57 lowers the maximum height of the exercise bar 15 in a zero resistance condition—i.e., the threshold point above which the force resistance assembly 12 becomes engaged. The threshold point may also comprise one extreme in the overall range of movement during a particular exercise; the other extreme being the highest point to which the exercise bar 15 is lifted away (or raised above) from the standing platform 11.

Figure 8:
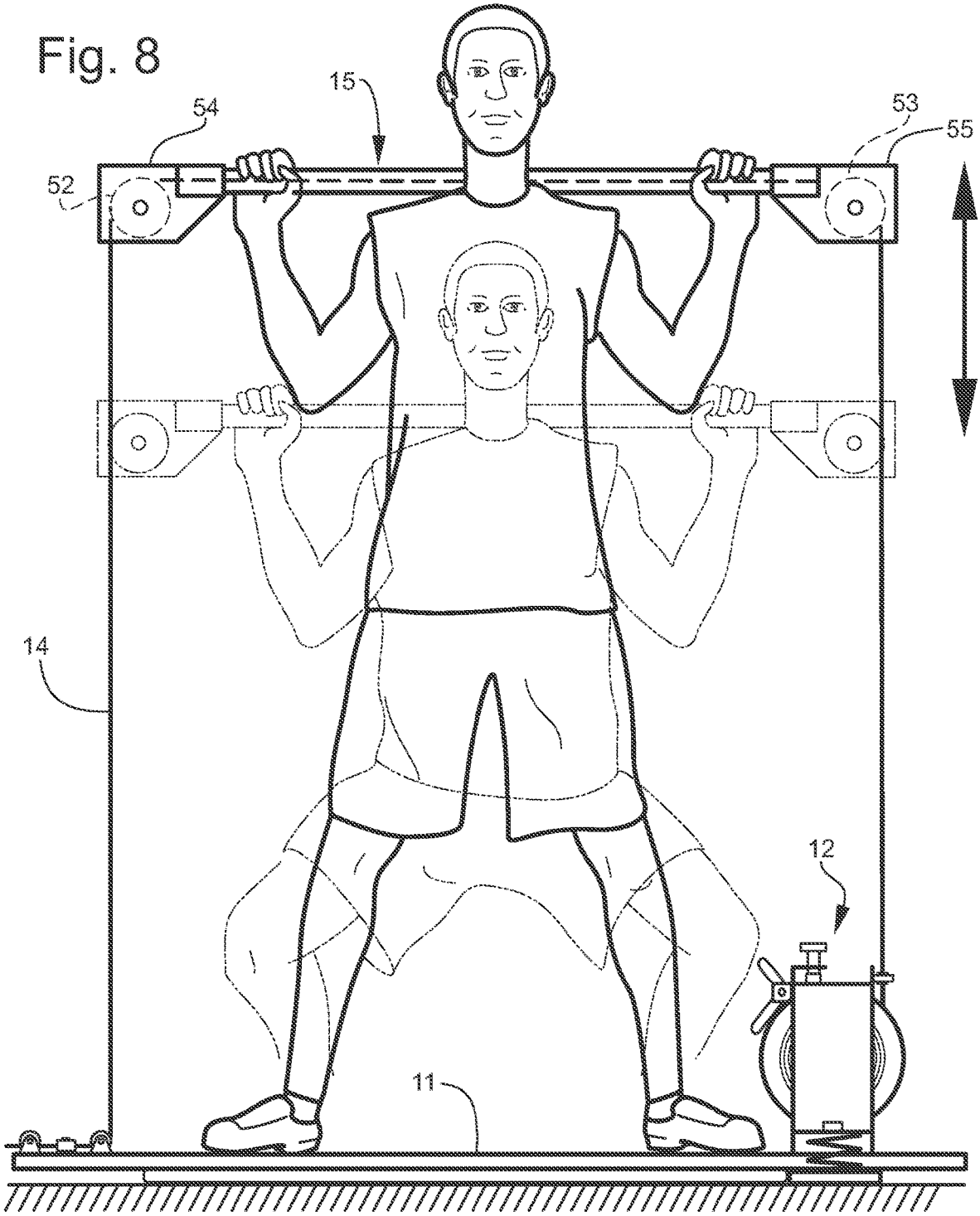
FIG. 8 is a view demonstrating use of the exercise device by a user performing a strength training exercise.

FIG. 8 demonstrates use of the exemplary exercise device 10 to perform full body squats. The user first establishes the zero-resistance height of the exercise bar 15, as previously described, by pulling the free end 14A of cable 14 through cam cleat 37. In a deep squatted position, the user places the exercise bar 15 behind the neck as shown. As the user begins to raise upwardly, the exercise bar 15 moves above the zero-resistance threshold point causing the force resistance assembly 12 to engage. The one-way cable spool 30 begins to rotate in the working direction to lengthen the cable 14 as the needle bearing 31 frictionally locks (or clamps) onto the hardened rotatable assembly shaft 22. Continued upward movement of the user and exercise bar 15 causes simultaneous rotation of the cable spool 30, assembly shaft 22, and disk rotor 25. The user force required to lengthen the cable 14 and thereby lift the exercise bar 15 is largely dictated by the hydraulic friction controller 28, as previously described, and the selected degree of engagement of friction pads 37, 38 against the disk rotor 22. Substantially smooth, uniform, constant resistance is applied throughout the entire range of movement of the exercise bar 15 as the user moves from the initial deep squatted position to a full standing position.

Figure 9:
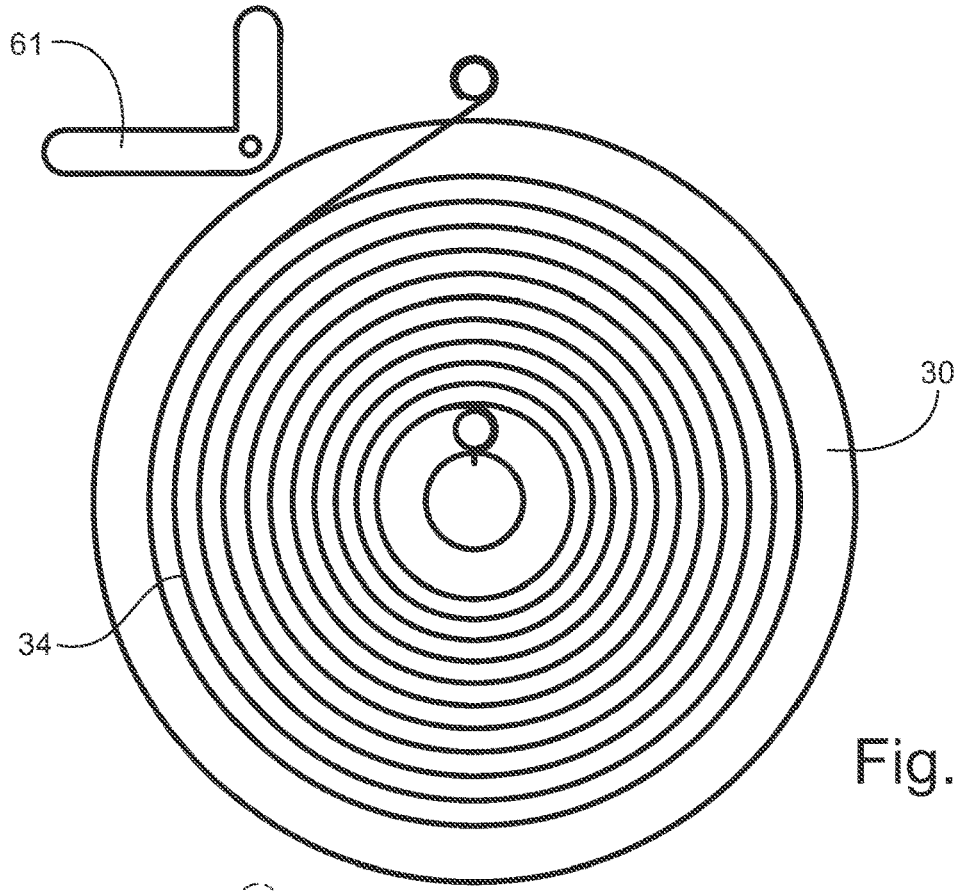
FIGS. 9 and 10 are views illustrating the pivoted foot stop in respective raised and lowered positions relative to the cable spool.
Figure 10:
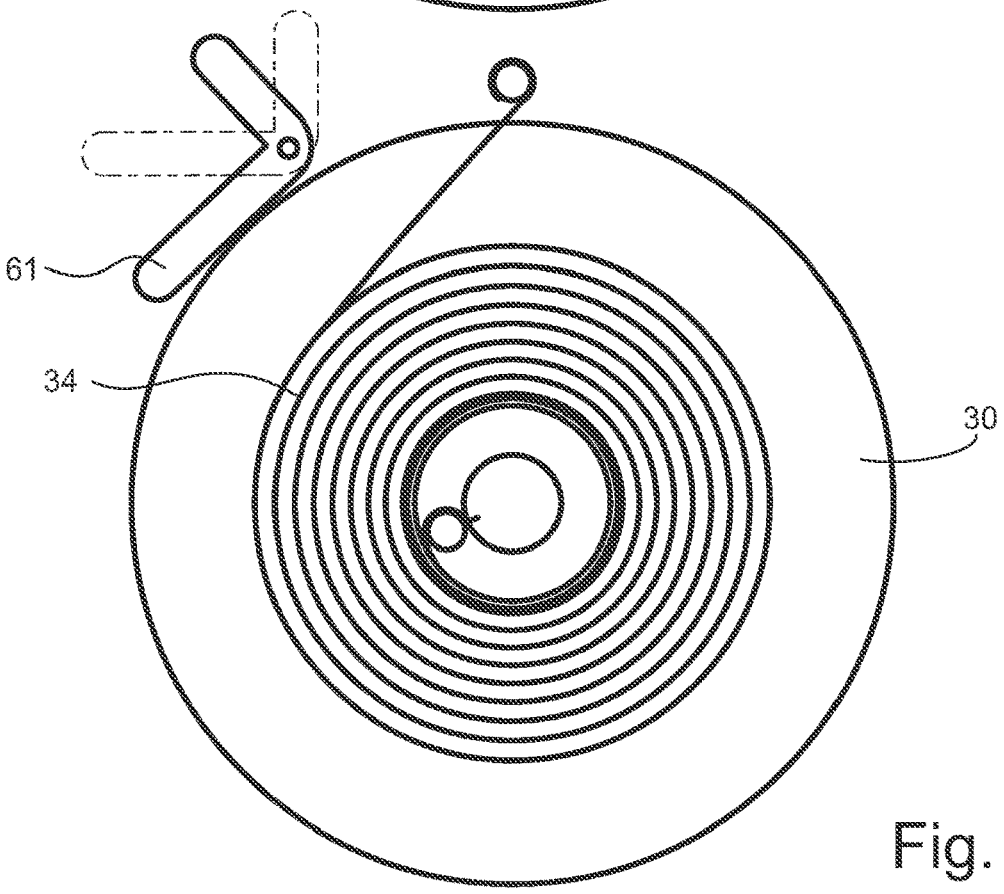

Moving from the full standing position back to the squatted position, torsion spring 34 causes the cable spool 30 to counter-rotate thereby unlocking the needle bearing 31 on the assembly shaft 22 and allowing the flexible cable 14 to retract and rewind within respective grooves 33 of cable spool 30 as the exercise bar 15 is lowered back towards the standing platform 11. The released cable spool 30 counter-rotates in the cable-wind-up direction independent of the assembly shaft 22 and disk rotor 25 (which both remain stationary). In the event a user desires to prevent or limit retraction (or shortening) of the cable 14 after completing a lift, a pivoted foot brake 61 best shown in FIGS. 9 and 10 may be employed to temporarily frictionally engage the cable spool 30 to stop its counter-rotation thereby setting the extended cable length such that the exercise bar 15 can be later relocated with essentially zero resistance back to its previous height above the standing platform 11. The spool-engaging surface of the foot brake 61 may comprise a rubber or other high friction material.

In addition to squats, the present exercise bar 15 and cleated cable attachment at the platform 11 may be used for other strength training exercises including, for example, military shoulder press, bench press, arm curls, arm extensions, bent-over rows, lat pulls, rowing exercises, and others. In alternative implementations, a shorter bar 15A shown in FIG. 1 may be attached to the free end 14A of the flexible cable 14 (via hook-and-eye or other cable connector), and used for exercises such as arm curls, arm extensions, and others. Other exercise bars and implements, such as angled bars, triangles, ropes, one-hand handles, and the like may also be used with the present device. The present exemplary exercise device 10 may provide resistance forces from 5 to 500 pounds, and could easily be adapted to provide more or less depending on the specific requirement. Additionally, the exemplary exercise device 10 may be used in combination with other strength training machines and implements, such as elastic bands, free weights, and others.

Referring to FIGS. 11-17, a personal force-resistance cable exercise device according to further exemplary embodiment of the present disclosure is shown generally at broad reference numeral 100. The exemplary exercise device 100 comprises a flat standing platform 111, a compact force resistance assembly 112 mounted on or adjacent the platform 111, a flexible steel cable 114 attached to the force resistance assembly 112, an elongated double-pulley exercise bar 115 secured to the cable 114, and an electronic programmable operator console 118. The exemplary force resistance assembly 112 comprises a rigid mounting frame 121, a rotatable steel axle 122 supported by bearings within the frame 121, a one-way cable spool 124 carried on the axle 122, and an adjustable magnetic braking device 125 operatively connected (via axle 122) to the cable spool 124.

Figure 12:
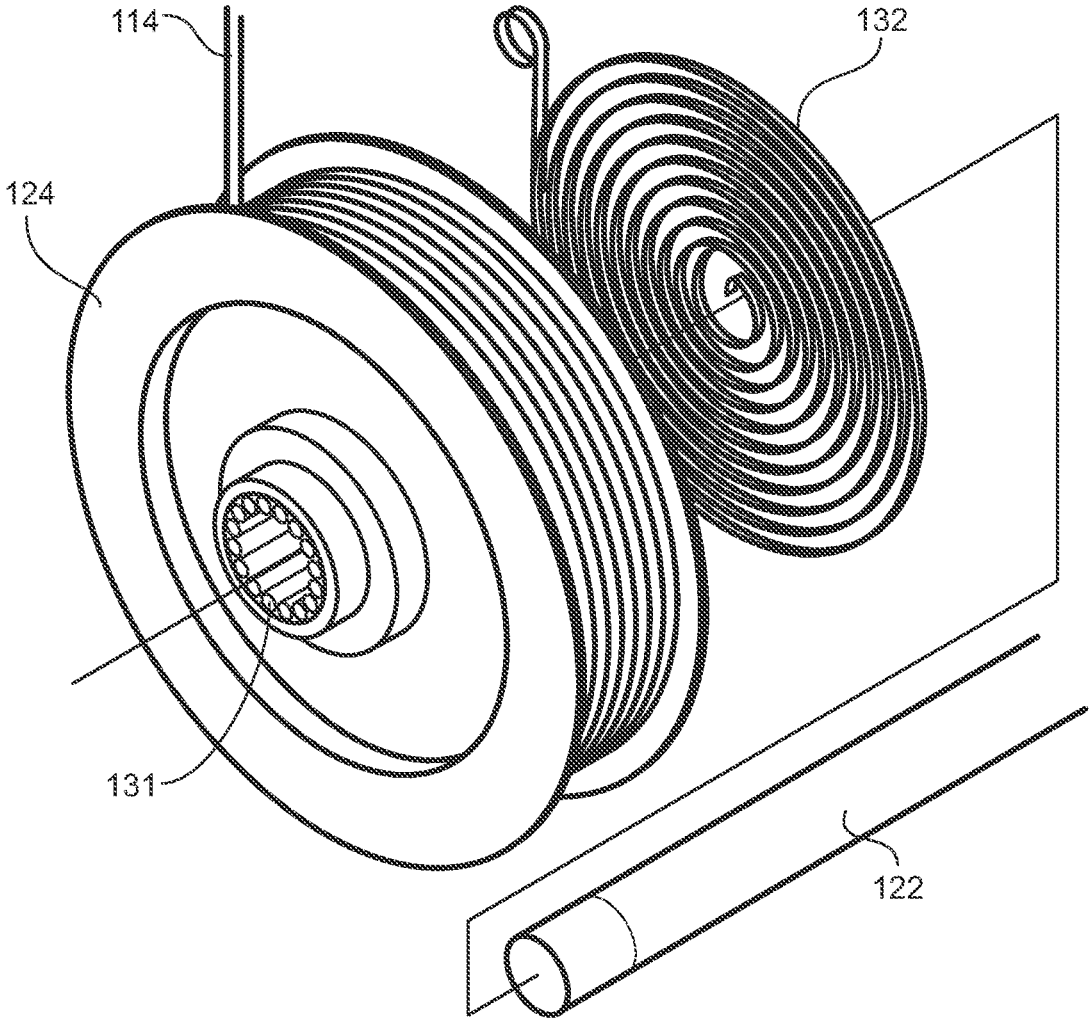
FIG. 12 is an exploded view illustrating various parts of the exemplary cable spool.

As best shown in FIG. 12, the exemplary one-way cable spool 124 comprises an integrally (or separately) formed one-way needle bearing 131 which locks to the steel axle 122 upon rotation of the cable spool 124 in a working force-resistance direction, and which releases from the axle 122 upon counter-rotation of the cable spool 124 in an opposite cable-wind-up direction. The flexible cable 114 is attached to the force resistance assembly 112 (e.g., at cable spool 124), and is adapted for winding on and unwinding from the cable spool 124 during use of the exercise device 100, as discussed below. The exemplary cable spool 124 may have circumferential surface grooves which serve to substantially limit overlap of the cable 114 when winding on the spool 124. A spiral torsion spring 132 or other biasing means is attached at one end to the mounting frame 121 and at its other end to the cable spool 124, and functions to normally urge counter-rotation of the cable spool 124 in the cable-wind-up direction.

Figure 11:
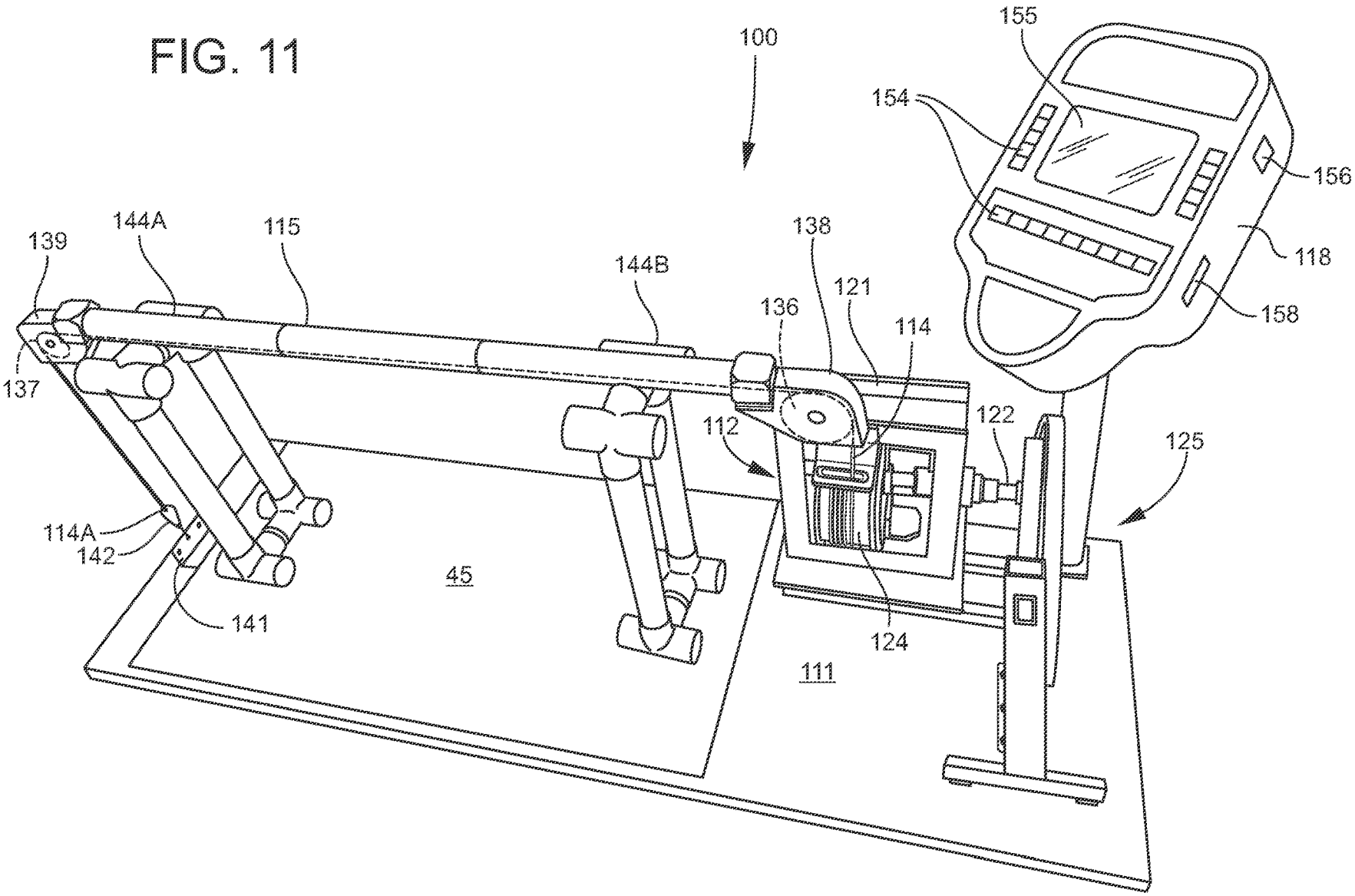
FIG. 11 is a perspective view of a personal force-resistance exercise device according to a further exemplary embodiment of the present disclosure.
Figure 13:
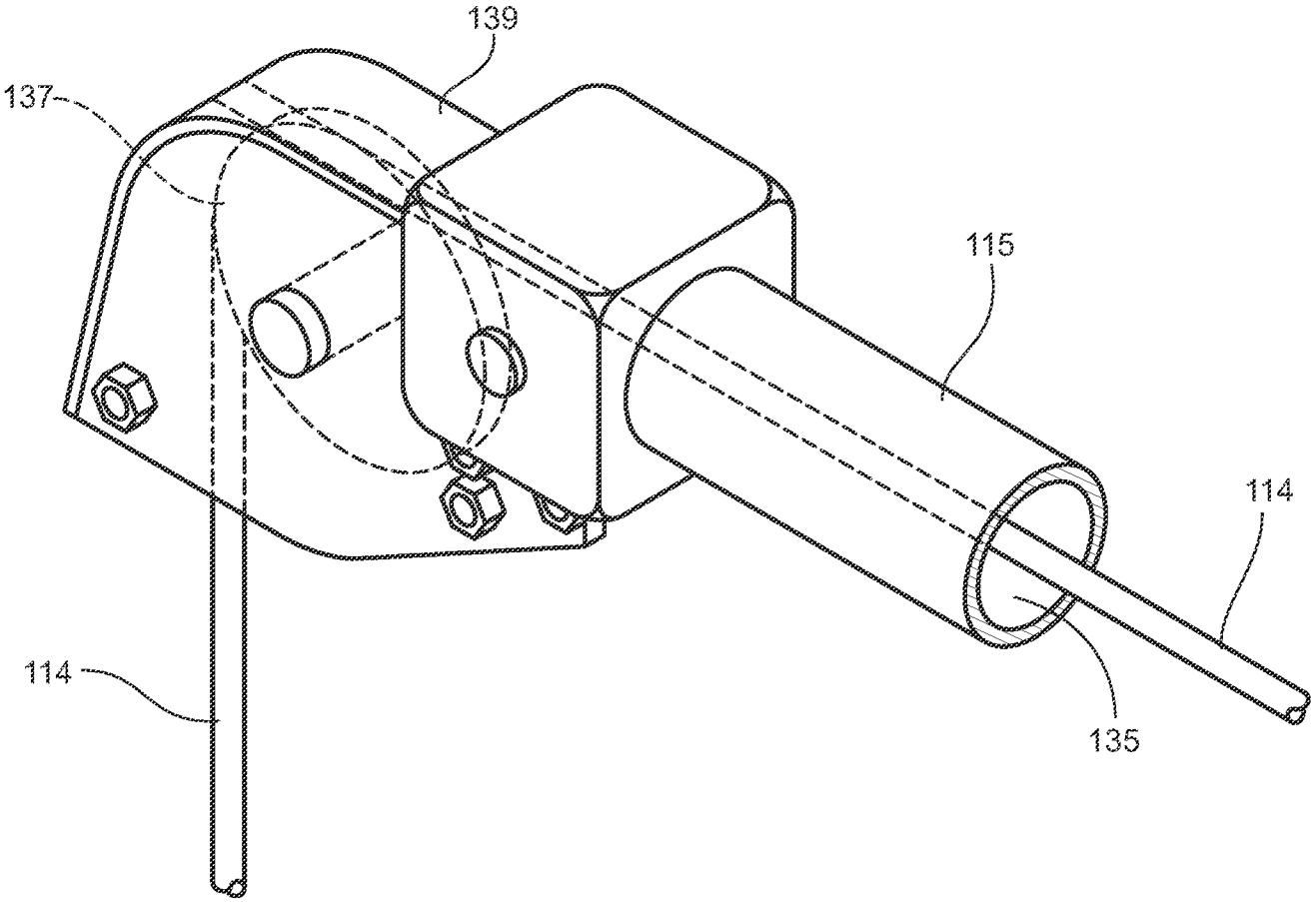
FIG. 13 is a fragmentary view of the exemplary exercise bar showing the end bracket and cable bearing (e.g., pulley), and the flexible cable passing through the exercise bar towards the standing platform.

Referring to FIGS. 11 and 13, the exemplary exercise bar 115 is slidably secured to the flexible cable 114, such that the exercise bar 115 can be manually lifted relative to the standing platform 111 with substantially smooth uniform resistance as the cable 114 lengthens from the spool 124. In the present embodiment, the exercise bar 115 comprises an elongated rigid hollow member 135 with respective cable pulleys 136, 137 (or bearings) located at opposite open ends. The cable pulleys 136, 137 are attached via brackets 138, 139. A looped free end 114A of the flexible cable 114 is passed into a first open end of the exercise bar 115 over cable pulley 136, extends through hollow member 135, and outwardly through the second open end over cable pulley 137 towards the standing platform 111. The cable free end 114A is releasably anchored to a fixed platform bracket 141 using a metal carabiner 142 or other suitable fastener. In a ready position shown in FIG. 11, the exercise bar 115 sits on an adjustably elevated bar rack 144A, 144B in a substantially zero resistance condition—tensioned only by the wind-up force of the torsion spring 132. An ultra-slim weigh pad 145 may be integrally formed with or adjacent the standing platform 111, and may operatively connect (e.g., wirelessly or via cable) to the electronic operator console 118 to communicate a measured real time force exerted by the user when performing an exercise.

Figure 14:
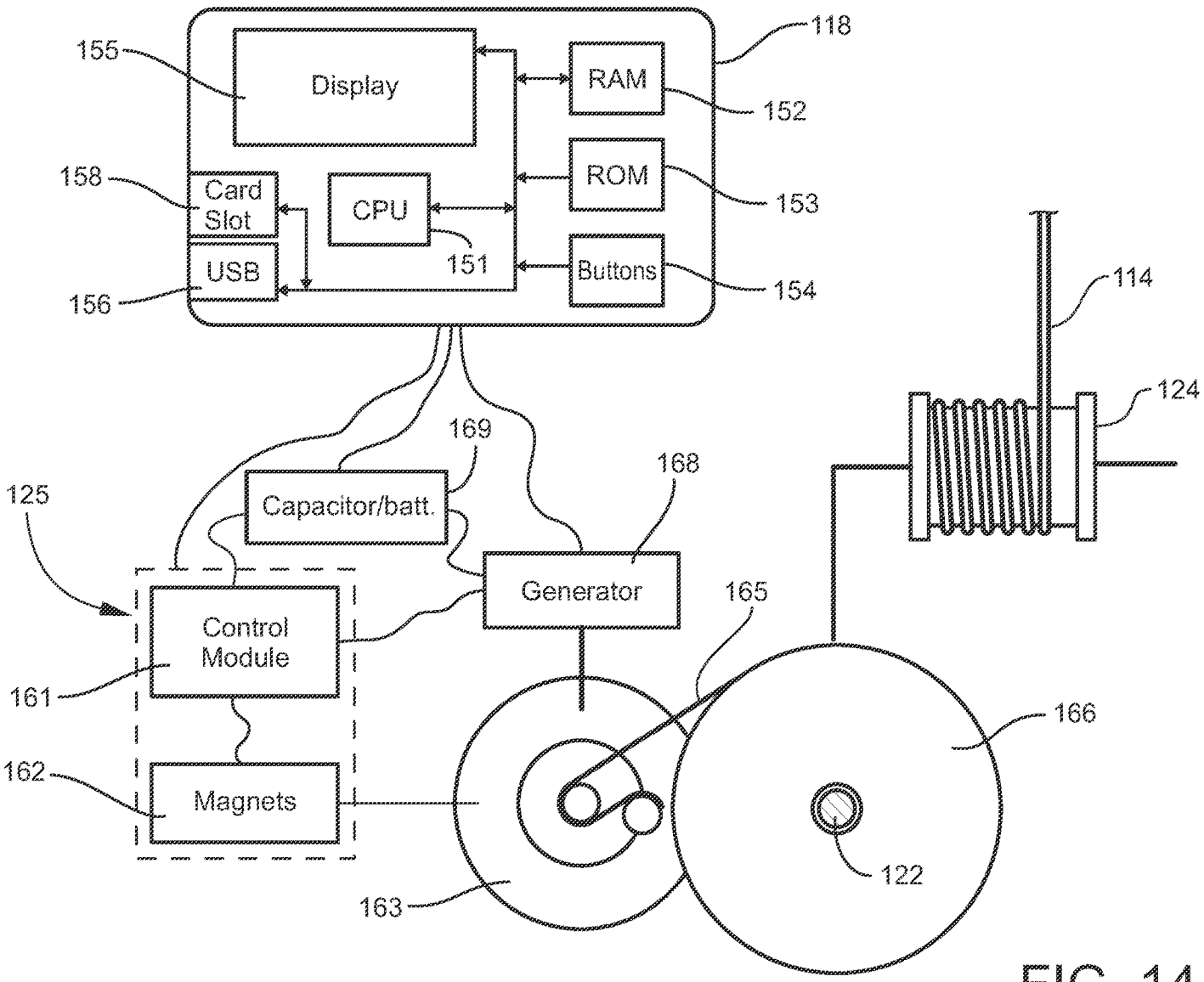
FIG. 14 is a schematic view illustrating various features of the operator console and exemplary force resistance assembly.

Referring to FIGS. 11 and 14, the exemplary programmable operator console 118 comprises a microcontroller CPU 151, RAM 152 for storing temporary information for workouts, exercises, and strength tests, ROM 153 for storing permanent program and user information, operator buttons 154 for navigating through menus and selecting options, a port for connecting (e.g., via cable) to the magnetic braking device 125, an LCD display 155 for displaying program and exercise information to the user, a USB port 156 for connecting via USB cable to external computing devices (including, e.g., smartphones, tablet computers, laptop computers, and the like) for downloading exercise routines and software upgrades, and a memory card slot/reader 158 for accepting an external memory card. The operator buttons 154 allow the user to negotiate forward and backwards through menus, and up and down through menu selections, in a conventional manner. Enter button selects options, undo button undoes selections, start/pause button starts or pauses console operation, and power button turns operator console on and off. In the present device 100, the operator buttons 154 enable a user to select between 1-40 different levels of force resistance generated by operation of the magnetic braking device 125, discussed below.

Magnetic Braking Device 125

Figure 15:
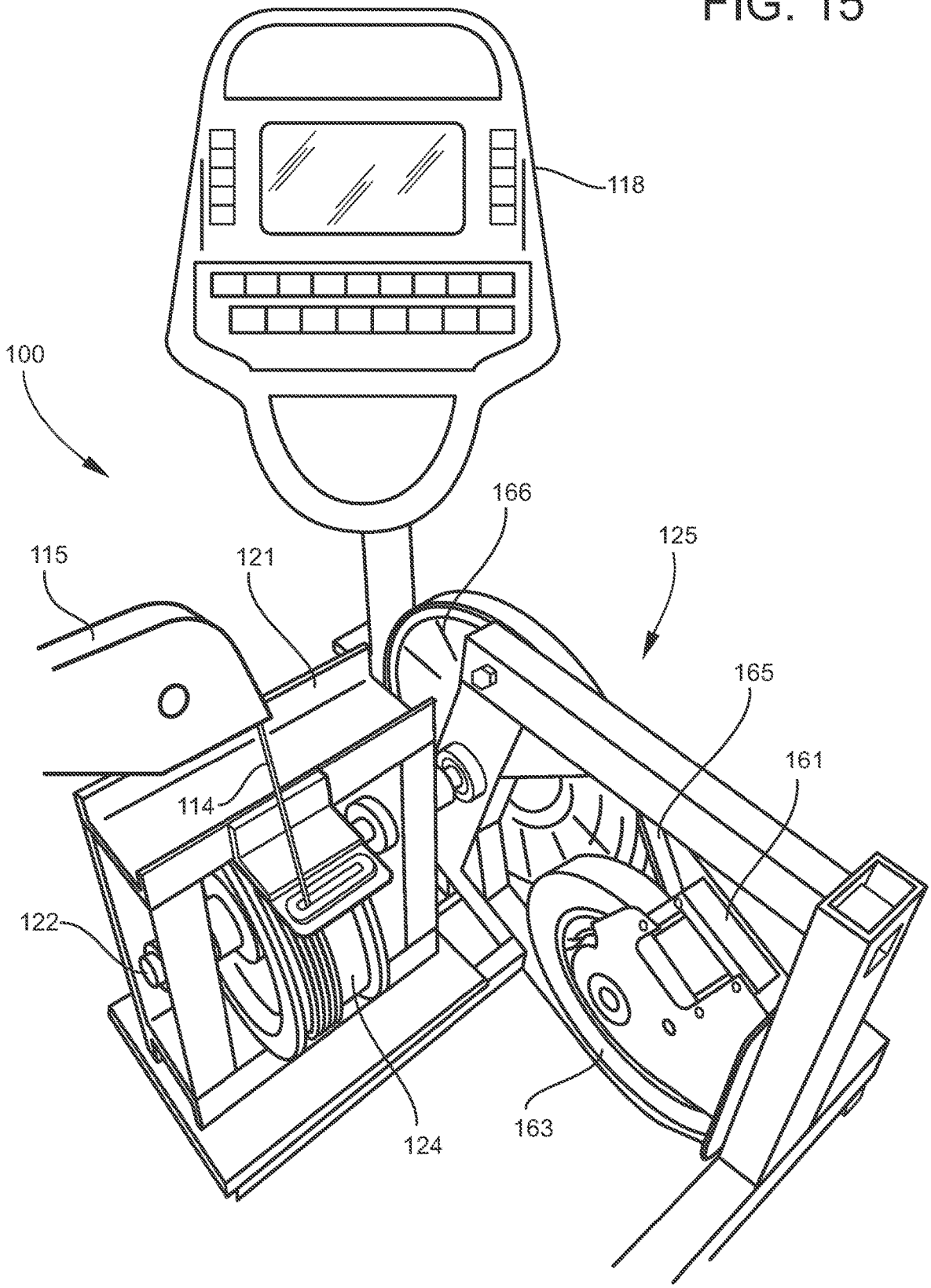
FIG. 15 is a fragmentary perspective view showing a portion of the exemplary exercise device.
Figure 16:
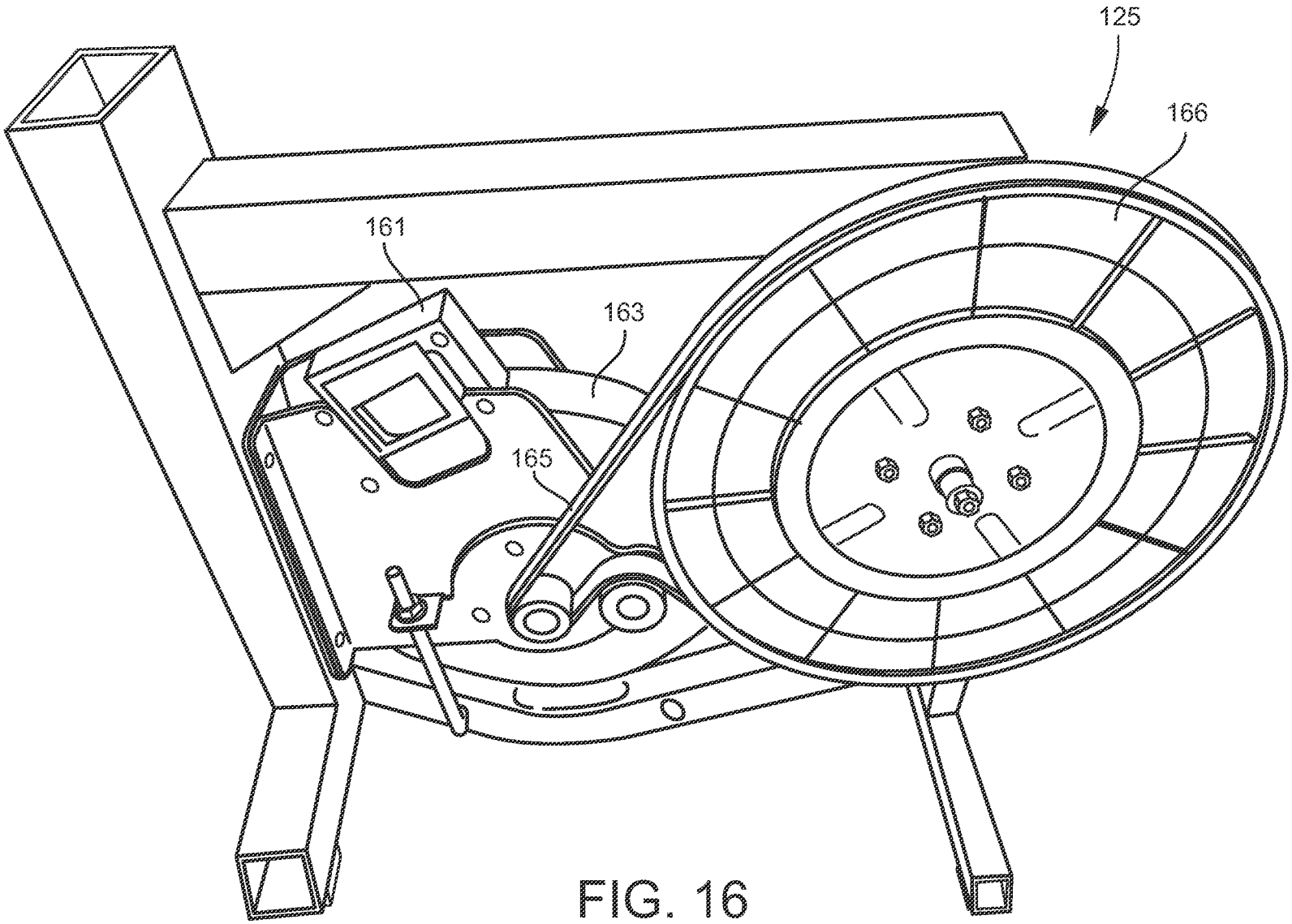
FIG. 16 is a fragmentary perspective view showing a further portion of the exemplary exercise device.

Referring to FIGS. 14, 15, and 16, the exemplary braking device 125 comprises an electromagnetic control module 161 operatively connected to the operator console 118 (e.g., via cable), and to one or more magnets 162 mounted adjacent a peripheral margin of a rotatable non-ferromagnetic metal flywheel 163. The magnets 162 may comprise permanent magnets, electromagnets, or a combination of electromagnets and permanent magnets. In one exemplary embodiment, the braking device 125 utilizes an eddy current braking (ECB) system. As best shown in FIG. 16, the metal flywheel 163 is connected through a friction (e.g., rubber) drive belt 165 to a rotatable pulley 166 affixed to the axle 122, such that one-way rotation of the cable spool 124 when performing an exercise causes the pulley 166 to spin thereby spinning the belt-attached flywheel 163 and activating the ECB system.

In the present ECB system, the flywheel 163 acts as a conductor to support induced eddy currents. As the flywheel 163 moves through graduated magnetic fields produced by the magnets 162, the induced eddy currents interact with the magnetic fields to provide a retarding or breaking function on the flywheel 163, which transfers directly to the belt-attached pulley 166 to the cable spool 124. The drag force in the ECB system is controlled by the amount of current passed through the electromagnet windings—the greater the current, the greater the braking force acting on the cable spool 124. The current level (1-40) is selected by the user via operator console 118. Maximum force resistance (or drag) is generated at level 40. Generator 168 connects to the flywheel 163 and supplies power to the electronic operator console 118 and braking device 125 during operation of the exercise device 100.

Because the braking force of the ECB system is dependant upon rotational velocity of the flywheel 163, the ECB system alone has no holding force when the flywheel 163 is stationary. To account for this, the exemplary exercise device 100 includes a hysteresis magnetic brake and/or adjustable position magnets capable of immediate braking even after the flywheel 163 has stopped rotating. The ECB system and the hysteresis system typically are accompanied by additional permanent and/or electromagnets which are adjustable in position with respect to the flywheel (see, e.g., U.S. Pat. No. 8,585,561) to add resistance during non-rotation and during rotation. Persistent short term power to the operator console 118 and braking magnets 162 may be supplied by a capacitor or rechargeable batteries 169. This short-term power supply 169 maintains temporary activation of the operator console 118 when the flywheel 163 is stopped, and enables a pre-selected level of current flow to the hysteresis magnet and/or specific magnet position control, thereby setting and maintaining an immediate desired level of exercise resistance. For example, assume the resistance level is set by the user at level 20 (via operator console) for a particular exercise. After performing an exercise set, the user may return the exercise bar 115 to the bar rack 144A, 144B and rest for 1-3 minutes before beginning a subsequent set. During this rest period, rotation of the flywheel 163 and therefore operation of the ECB system may cease. Unless the resistance level is reset by the user via operator console 118, when the user resumes exercising the persistent power supply 169 will maintain a level 20 resistance immediately as the exercise bar 115 is lifted from the rack 144A, 144B and before full rotation of the flywheel 163. As the flywheel 163 reaches a threshold speed, the generator 168 begins supplying operating current to the exercise device 100, while the operator console 118 automatically decreases current flow to the hysteresis brake and/or changes position of the magnets, it increases current to the ECB system as required by the preselected resistance level. In alternative embodiments, longer term persistent power supply may be achieved by connecting the exercise device 100 to a 120-volt AC power source.

Alternatively, or in addition to the braking system described above, the present exercise device 100 may employ other resistance means, including controllable fluid resistance elements, electromagnetic motors, magnetic particle brakes, and magnetic fluid resistance elements. The exemplary braking device 125 can utilize a combination of hysteresis brakes and eddy current brakes, as previously described, or hysteresis braking only, or eddy current braking only.

Exemplary Exercises

Figure 17:
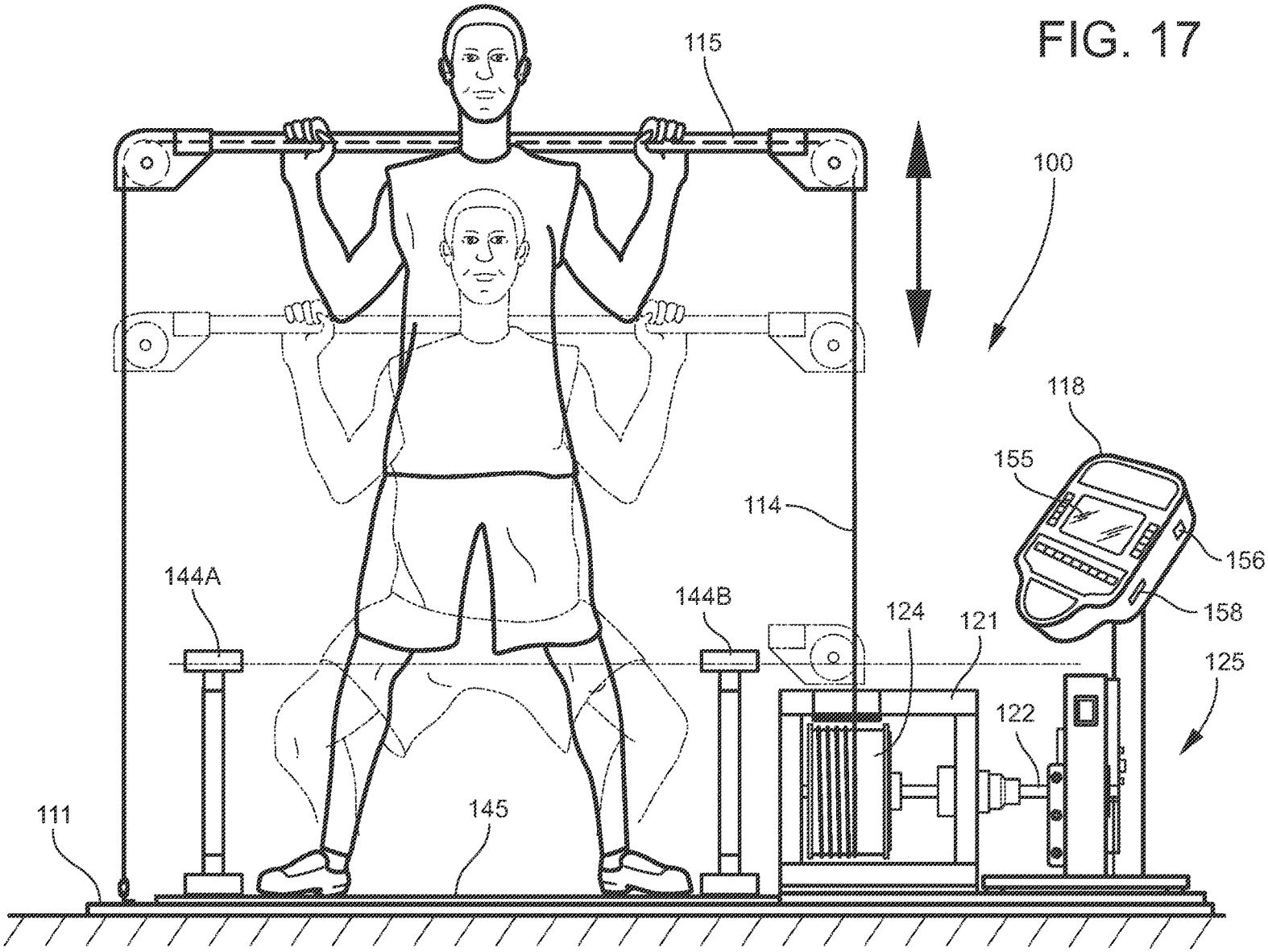
FIG. 17 is a view demonstrating use of the exercise device by a user performing a strength training exercise.
Figure 18:
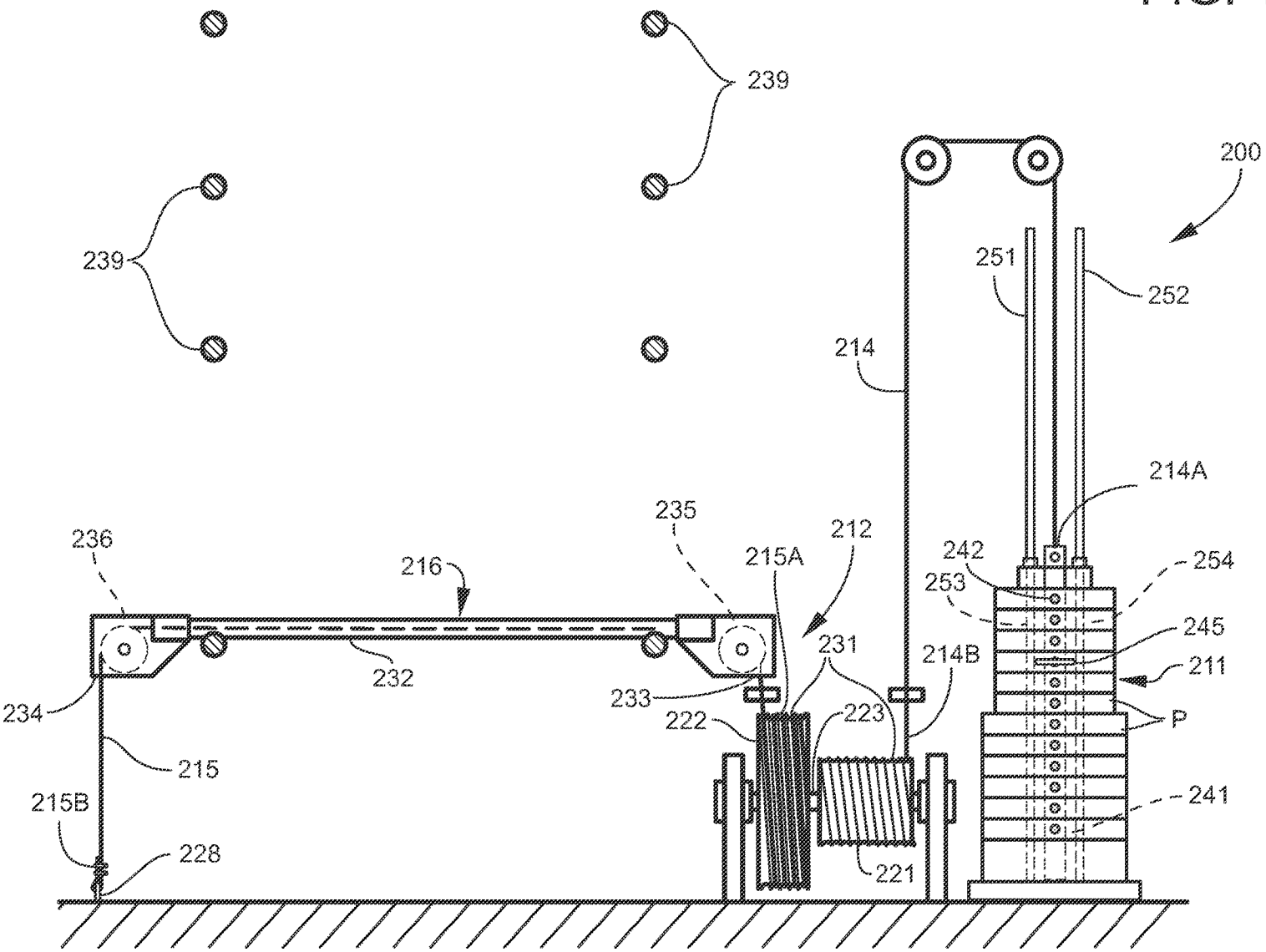
FIG. 18 illustrates a cable exercise device according to yet another exemplary embodiment of the present disclosure.
Figure 19:
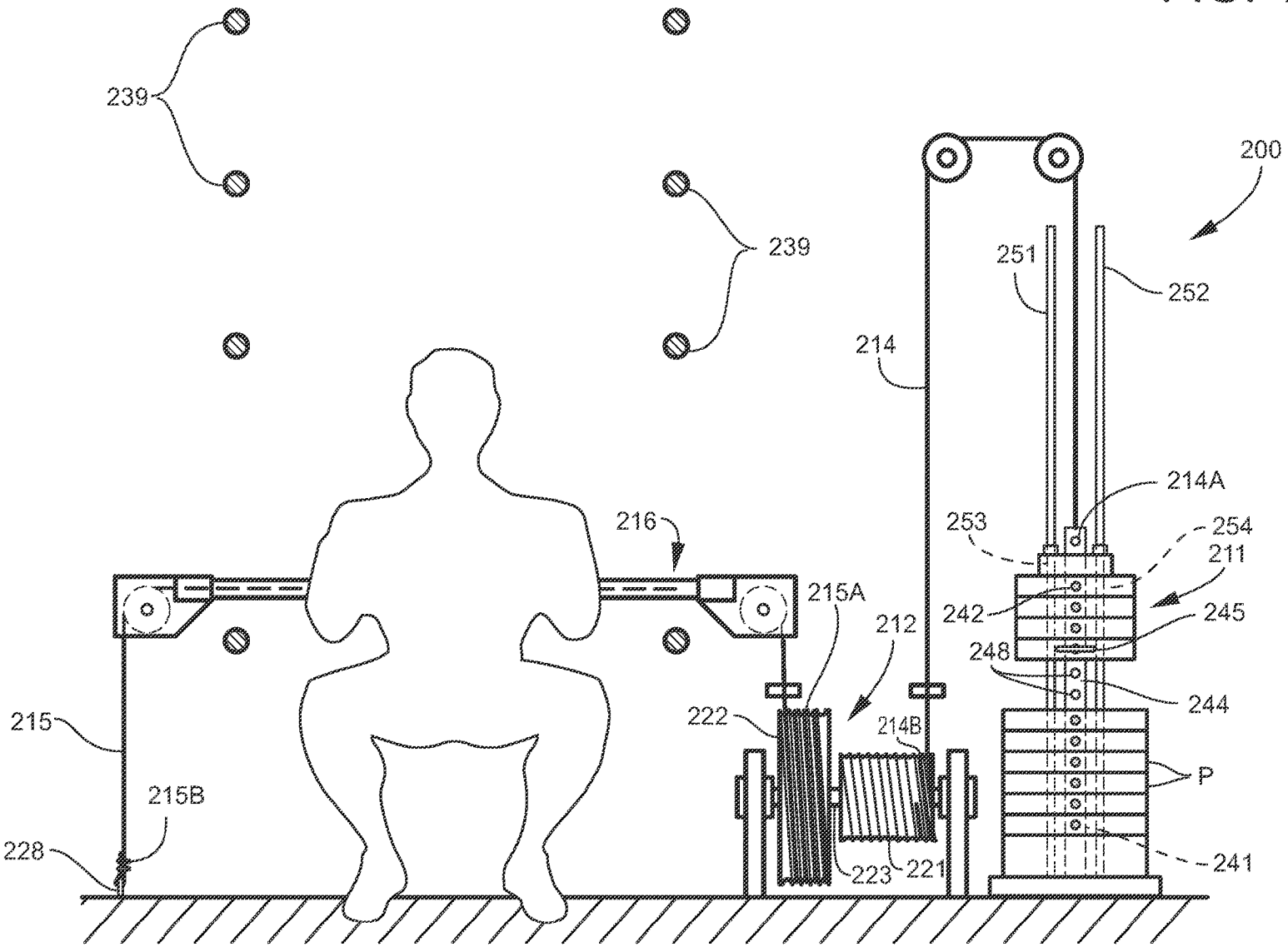
FIGS. 19-22 are sequential views demonstrating displacement of an exercise bar of the cable exercise device from a lowermost position to progressively higher elevated positions.
Figure 20:
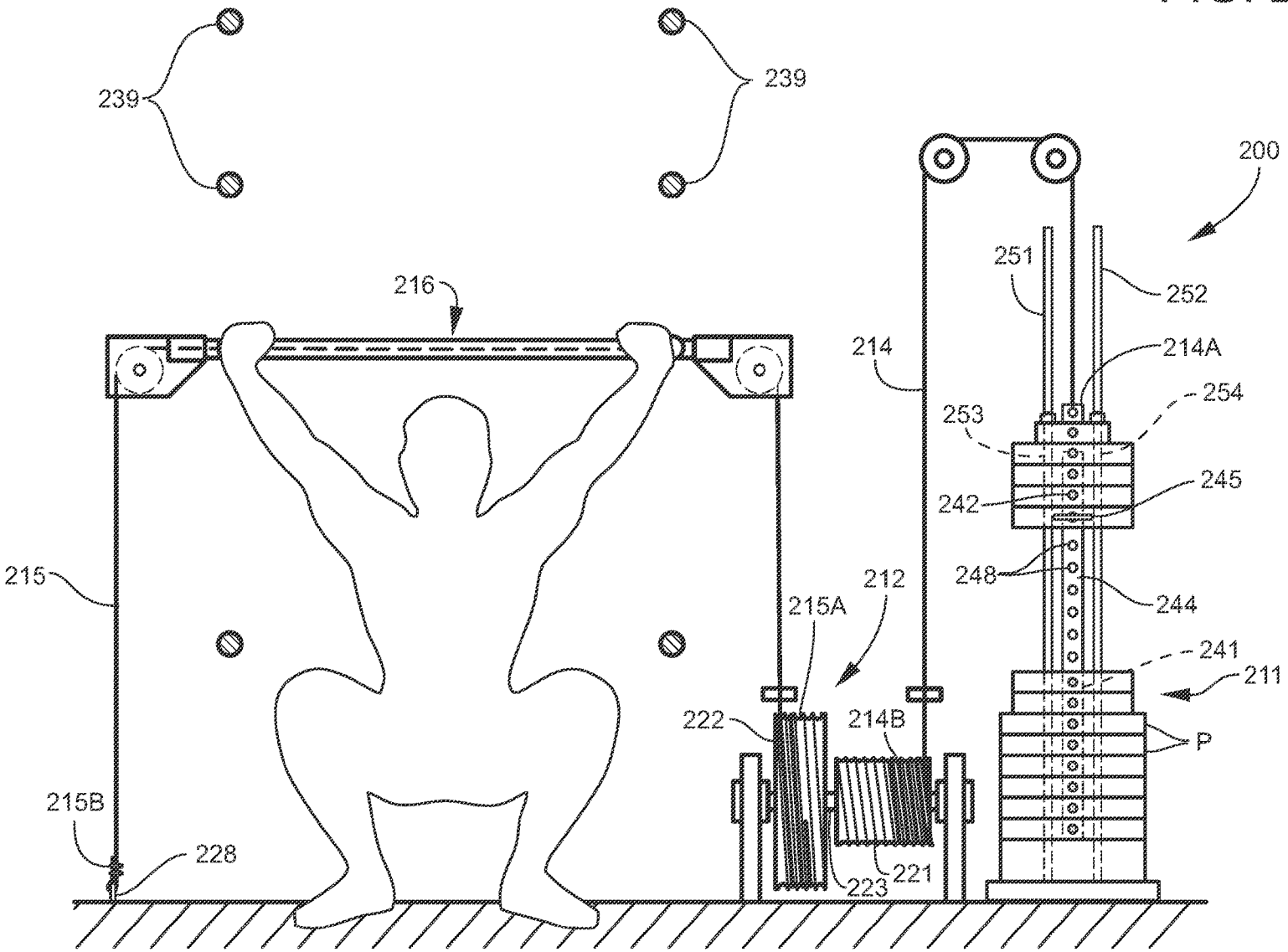
Figure 21:
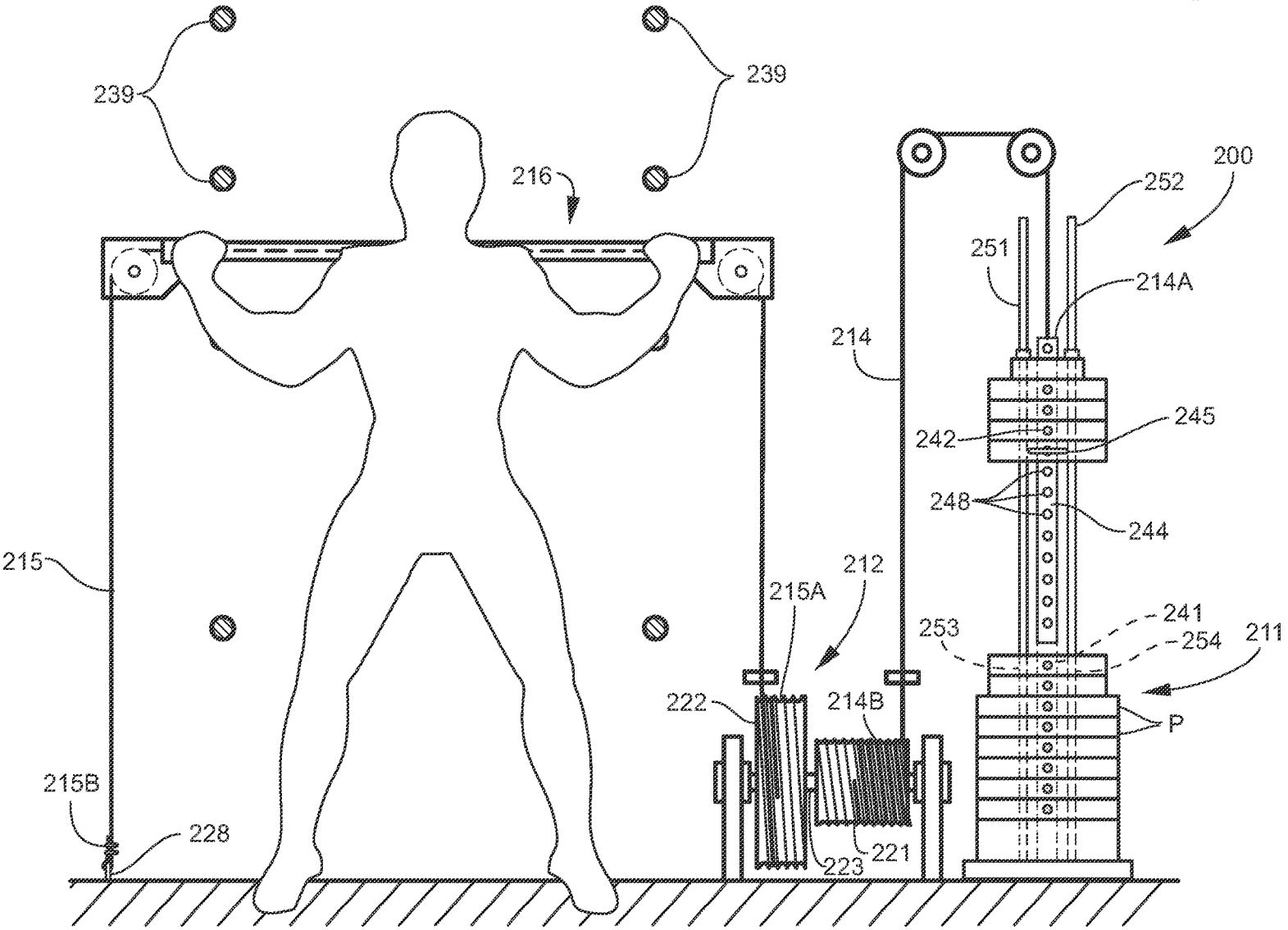
Figure 22:
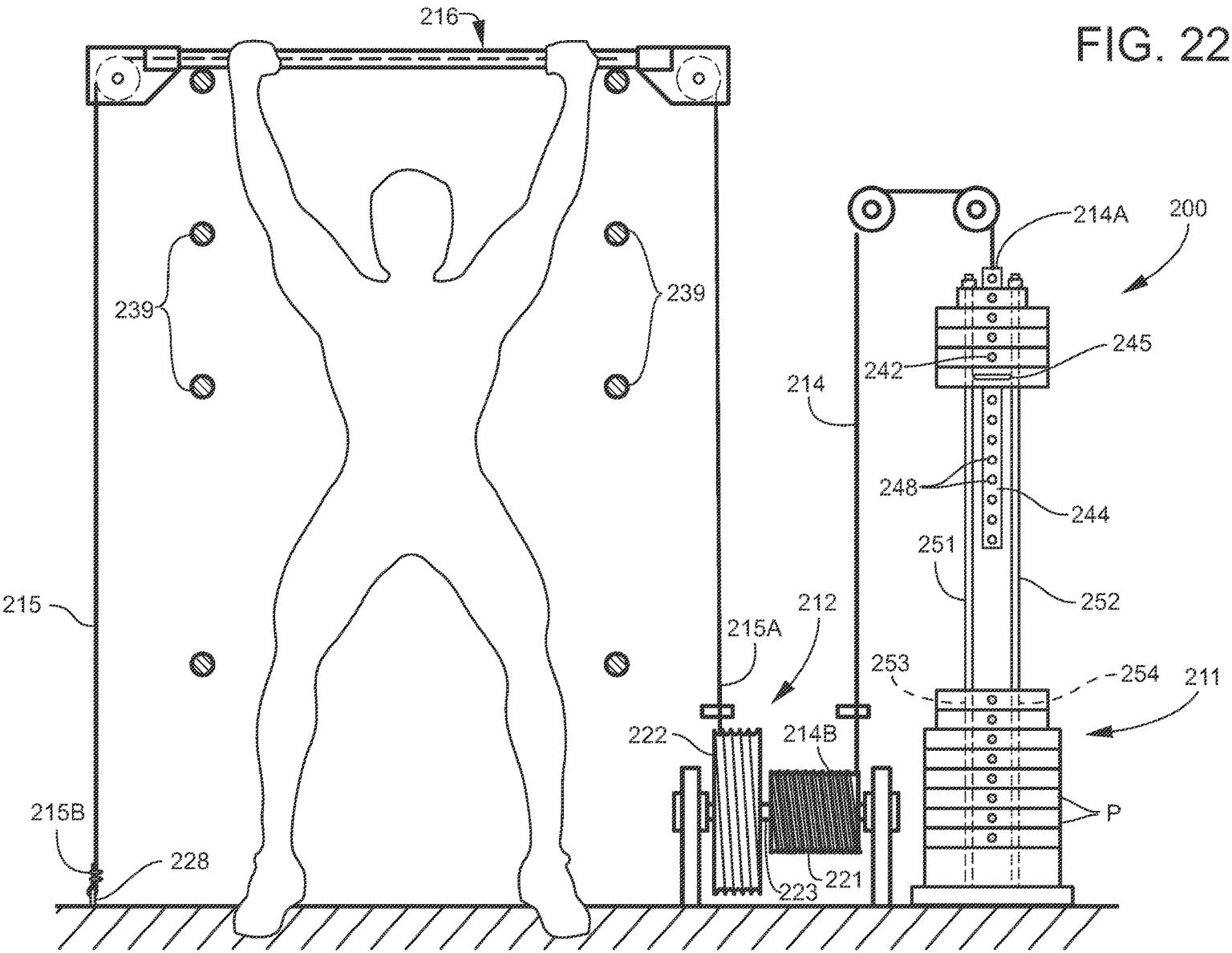

FIG. 17 demonstrates use of the exemplary exercise device 100 to perform full body squats. In a deep squatted position, the user places the exercise bar 115 behind the neck as shown. As the user begins to raise upwardly, the exercise bar 115 pulls the cable 114 from the one-way cable spool 124. The cable spool 124 rotates in the working direction to lengthen the cable 114 as the needle bearing 131 frictionally locks (or clamps) onto the steel axle 122. Continued upward movement of the exercise bar 115 causes simultaneous rotation of the cable spool 124, axle 122, and pulley 166. Rotation of the pulley 166 causes the belt-attached flywheel 163 to spin. Once the flywheel 163 is spinning, the user force required to lengthen the cable 114 and thereby lift the exercise bar 115 is largely dictated by the ECB system of the magnetic braking device 125, as previously described, and the selected level of force resistance. Substantially smooth, uniform, constant resistance is applied throughout the entire range of movement of the exercise bar 115 as the user moves from the initial deep squatted position to a full standing position.

Moving from the full standing position back to the squatted position, torsion spring 132 causes the cable spool 124 to counter-rotate thereby unlocking the needle bearing 131 on the axle 122 and allowing the flexible cable 114 to retract and rewind within respective grooves of cable spool 124 as the exercise bar 115 is lowered back towards the standing platform 111. The released cable spool 124 counter-rotates in the cable-wind-up direction independent of the axle 122 and pulley 166 (which both continue rotating in the opposite direction). The exemplary operator console 118 records each exercise and repetition of the user, and may incorporate a digital camera (not shown) for capturing video of the user while exercising for subsequent playback via the LCD display 155. The user video may be stored on an external memory card, or transferred from the operator console 118 via USB connection to any other independent computing device, thereby allowing subsequent analysis and critiquing of each workout over any given period of time. The magnetic braking device 125 creates a specific resistance force as set by the user on the operator console 118 for a maximum speed of unwinding the cable 114. As the user's muscles fatigue during the exercise, a slower unwind speed is allowed with less resistance allowing a more effective exercise.

In addition to squats, the present exercise bar 115 may be used for other strength training exercises including, for example, military shoulder press, bench press, arm curls, arm extensions, bent-over rows, lat pulls, rowing exercises, and others. In alternative implementations, a shorter bar (not shown) may be attached to the free end of the flexible cable (e.g., via carabiner), and used for exercises such as arm curls, arm extensions, and others. Other exercise bars and implements, such as angled bars, triangles, ropes, one-hand handles, and the like may also be used with the present device. The present exemplary exercise device may provide resistance forces from 5 to 500 pounds, and could easily be adapted to provide more or less depending on the specific requirement. Additionally, the exemplary exercise device may be used in combination with other strength training machines and implements, such as elastic bands, free weights, and others.

Yet another exemplary embodiment of the present disclosure is illustrated in FIGS. 18-22. The exemplary cable exercise device 200 incorporates a vertically movable weight stack 211, a rotatable spool assembly 212, first and second flexible steel cables 214, 215, and a movable exercise implement—such as exercise bar 216. The spool assembly 212 comprises spaced apart small and large cable spools 221, 222 affixed to a common rotatable spool shaft 223. In the exemplary embodiment, the small cable spool 221 has a diameter approximately one-half the diameter of the large cable spool 222. The first cable 214 has a terminal end 214A attached to the weight stack 211, and a winding end 214B attached to the small cable spool 221. As discussed further below, the winding end 214B of the first cable 214 is adapted to wind onto and unwind from the small cable spool 221 on a first side of the spool shaft 223 upon rotation of the spool assembly 212. The second cable 215 has a winding end 215A attached to the large cable spool 222, and extends from the large cable spool 222 to a terminal end 215B attached to a floor anchor 228. The winding end 215A of the second cable 215 is designed to wind onto and unwind from the large cable spool 222 on a second side of the spool shaft 223 upon rotation of the spool assembly 212. Each of the small and large cable spools 221, 222 may have a plurality of circumferential grooves 231 adapted for controlling overlap of the first and second cables 214, 215 when winding upon and unwinding from respective spools. The exemplary spools 221, 222 may also incorporate any one or more of the features of spool 30 discussed above, including (e.g.) a one-way needle bearing, torsion spring, and others.

As demonstrated in FIGS. 19-22, the exercise bar 216 is adapted for being employed by a user performing an exercise, such as leg squats and military presses. The exemplary bar 216 may be identical to bar 15 previously described. Like bar 15, the exercise bar 216 comprises an elongated rigid hollow member 232 having a cable-entry end 233 and an opposing cable-exit end 234, and first and second bar guides 235 and 236 located at respective cable-entry and cable-exit ends 233, 234. The second cable 215 extends through the hollow bar 216 and outwardly from its cable-exit end 234 to the floor anchor 228. Positive displacement of the exercise bar 216 when lifted causes the second cable 215 to gradually unwind from the large cable spool 222 thereby rotating the spool assembly 212 while simultaneously causing the first cable 214 to gradually wind upon the small cable spool 221. Vertically lifting the exercise bar 216 displaces the weight stack 211 raising it vertically from its initial at-rest position shown in FIG. 18 to the progressively elevated positions in FIGS. 19-22.

In the exemplary embodiment, the present weight stack 211 comprises a plurality of individual weight stack plates "P". The plates "P" may include one or more of a variety of different weights, such as 5 lb, 10 lb, 15 lb, and 20 lb weight plates—each having an industry standard thickness of 1.0 inch. Each plate "P" has top and bottom planar surfaces, and vertical sides extending between the top and bottom surfaces. Each plate "P" further defines a central shaft opening 241 formed between its top and bottom major surfaces, and a central pin opening 242 formed through at least one side of the plate and communicating with the shaft opening 241. An elongated selector shaft 244 is attached to the terminal end 214A of the first cable 214, and designed to extend through the vertically aligned shaft openings 241 formed with the weight stack plates "P". A weight stack pin 245 inserts through the pin opening 242 of a selected weight stack plate "P", and into an aligned one of a plurality of longitudinally spaced pin holes 248 formed with the selector shaft 244. First and second vertical guide rods 251, 252 extend through additional aligned openings 253, 254 formed with the weight stack plates "P", and function to guide vertical movement of the weight stack 211 between its initial at-rest position and the elevated position.

A conventional self-standing bar rack 238 with fixed extensions 239 (remainder of the rack not shown) may be used to temporarily place and hold the exercise bar 216 at each of its elevated positions. With the weight pin 245 removed, the user may lift and place the exercise bar 216 at a desired "starting" elevation on horizontally aligned extensions 239 of the rack. In this condition, the only downward force acting on the rack-supported bar 216 is that of the selector shaft 244 and typically a first (or "base") weight plate. The user then reinserts the weight pin 245 into the weight stack 211 and selector shaft 244, choosing a desired number of weight plates "P" to be lifted as the user raises the exercise bar 216 upwardly off the rack from the starting elevation. Alternatively, the user may lift the exercise bar 216 to the desired rack elevation on extensions 239 with the desired number of weight plates already selected. To relieve the downward force acting on the rack extensions 239 in this starting elevation, a second weight pin 245 may be inserted through the top plate "P" remaining on the weight stack 211 and through the corresponding aligned hole in the selector shaft 244. The second pin 245 thereby supports the load if the exercise bar 216 is lowered from the starting elevation.

In addition to the above, the exemplary cable exercise device 200 may incorporate other parts and elements commonly found in conventional cable exercise devices which use stacked weights. In the present and alternative embodiments, the exemplary device may further include pulley mounts, rubber donut cushions, damper springs, cable mounting hardware, add-on plates, number stickers, and the like.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

The invention claimed is:

1. A cable exercise device, comprising:

a vertically movable weight stack;

a rotatable spool assembly mounted proximate said weight stack, and comprising spaced apart large and small cable spools affixed to a common rotatable spool shaft;

a first cable having a terminal end attached to said weight stack and a winding end attached to the small cable spool, the winding end of said first cable adapted to wind onto and unwind from the small cable spool on a first side of said spool shaft upon rotation of said spool assembly;

a second cable having a winding end attached to the large cable spool and extending from the large cable spool to a terminal end, the winding end of said second cable adapted to wind onto and unwind from the large cable spool on a second side of said spool shaft upon rotation of said spool assembly; and a movable exercise implement secured to said cable exercise device by the terminal end of said second cable, and adapted for being employed by a user performing an exercise, whereby positive displacement of said exercise implement when lifted causes said second cable to unwind from the large cable spool thereby rotating said spool assembly while simultaneously causing said first cable to wind upon the small cable spool, such that said first cable lifts said weight stack vertically from an initial at-rest position to an elevated position.

2. The cable exercise device according to claim 1, wherein said weight stack comprises a plurality of individual weight stack plates, each plate having top and bottom major surfaces and sides extending between said top and bottom surfaces.

3. The cable exercise device according to claim 2, wherein each weight stack plate defines a central shaft opening formed between its top and bottom major surfaces, and a central pin opening formed through at least one side of said plate and communicating with said shaft opening.

4. The cable exercise device according to claim 3, and comprising an elongated selector shaft attached to the terminal end of said first cable, and adapted for extending through the shaft openings formed with said weight stack plates.

5. The cable exercise device according to claim 4, and comprising a weight stack pin adapted for inserting through the pin opening of a selected weight stack plate and into an aligned one of a plurality of longitudinally spaced pin holes formed with said selector shaft.

6. The cable exercise device according to claim 1, and comprising a floor anchor attaching the terminal end of said second cable.

7. The cable exercise device according to claim 6, wherein said exercise implement comprises an elongated hollow bar having a cable-entry end and an opposing cable-exit end, and first and second bar guides located at respective cable-entry and cable-exit ends, and wherein said second cable extends through said bar and outwardly from its cable-exit end towards said floor anchor.

8. The cable exercise device according to claim 1, and comprising first and second vertical guide rods adapted for guiding vertical movement of said weight stack between its initial at-rest position and the elevated position.

9. The cable exercise device according to claim 1, wherein the large cable spool of said spool assembly comprises a plurality of circumferential grooves adapted for controlling overlap of said second cable when winding upon and unwinding from said spool.

10. The cable exercise device according to claim 1, wherein the small cable spool of said spool assembly comprises a plurality of circumferential grooves adapted for controlling overlap of said first cable when winding upon and unwinding from said spool.

11. The cable exercise device according to claim 1, and comprising a self-standing rack with cooperating extensions adapted to temporarily hold said exercise implement at a desired elevated position.

12. A cable exercise device, comprising:

a vertically movable weight stack comprising a plurality of individual weight stack plates, each plate having top and bottom major surfaces and sides extending between said top and bottom surfaces;

a rotatable spool assembly mounted proximate said weight stack, and comprising spaced apart large and small cable spools affixed to a common rotatable spool shaft;

a first cable having a terminal end attached to said weight stack and a winding end attached to the small cable spool, the winding end of said first cable adapted to wind onto and unwind from the small cable spool on a first side of said spool shaft upon rotation of said spool assembly;

a second cable having a winding end attached to the large cable spool and extending from the large cable spool to a terminal end attached to a floor anchor, the winding end of said second cable adapted to wind onto and unwind from the large cable spool on a second side of said spool shaft upon rotation of said spool assembly; and a movable exercise implement adapted for being employed by a user performing an exercise, and comprising an elongated hollow bar having a cable-entry end and an opposing cable-exit end, and first and second bar guides located at respective cable-entry and cable-exit ends, and wherein said second cable extends through said bar and outwardly from its cable-exit end towards said floor anchor, whereby positive displacement of said exercise implement when lifted causes said second cable to unwind from the large cable spool thereby rotating said spool assembly while simultaneously causing said first cable to wind upon the small cable spool, such that said first cable lifts said weight stack vertically from an initial at-rest position to an elevated position.

13. The cable exercise device according to claim 12, wherein each weight stack plate defines a central shaft opening formed between its top and bottom major surfaces, and a central pin opening formed through at least one side of said plate and communicating with said shaft opening.

14. The cable exercise device according to claim 13, and comprising an elongated selector shaft attached to the terminal end of said first cable, and adapted for extending through the shaft openings formed with said weight stack plates.

15. The cable exercise device according to claim 14, and comprising a weight stack pin adapted for inserting through the pin opening of a selected weight stack plate and into an aligned one of a plurality of longitudinally spaced pin holes formed with said selector shaft.

16. The cable exercise device according to claim 12, and comprising first and second vertical guide rods adapted for guiding vertical movement of said weight stack between its initial at-rest position and the elevated position.

17. The cable exercise device according to claim 12, wherein each of the large and small cable spools of said spool assembly comprise a plurality of circumferential grooves adapted for controlling overlap of said first and second cables when winding upon and unwinding from respective spools.

18. The cable exercise device according to claim 12, and comprising a self-standing rack with cooperating extensions adapted to temporarily hold said exercise implement at a desired elevated position.

* * * * *